US009147969B2

(12) United States Patent
Takenaga et al.

(10) Patent No.: US 9,147,969 B2
(45) Date of Patent: Sep. 29, 2015

(54) CONNECTOR WITH ADJUSTABLE LOCKING FORCE

(71) Applicant: Japan Aviation Electronics Industry, Ltd., Tokyo (JP)

(72) Inventors: Yuichi Takenaga, Tokyo (JP); Takayuki Nishimura, Tokyo (JP); Hiroaki Obikane, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 34 days.

(21) Appl. No.: 14/163,549

(22) Filed: Jan. 24, 2014

(65) Prior Publication Data

US 2014/0273587 A1 Sep. 18, 2014

(30) Foreign Application Priority Data

Mar. 14, 2013 (JP) ..... 2013-051976
Sep. 26, 2013 (JP) ..... 2013-200128

(51) Int. Cl.

| | |
|---|---|
| ***H01R 12/00*** | (2006.01) |
| ***H01R 13/627*** | (2006.01) |
| ***H01R 13/20*** | (2006.01) |
| *H01R 12/71* | (2011.01) |
| *H01R 12/73* | (2011.01) |

(52) U.S. Cl.

CPC ..... *H01R 13/6275* (2013.01); *H01R 13/20* (2013.01); *H01R 12/716* (2013.01); *H01R 12/73* (2013.01)

(58) Field of Classification Search

CPC .... H01R 12/57; H01R 12/707; H01R 23/725; H01R 13/41; H01R 13/6275; H01R 13/6272; H01R 13/6273; H01R 13/6271; H01R 13/506; H01R 13/639; H01R 13/6395; H01R 13/62; H01R 13/627; H01R 12/716; H01R 9/096

USPC ..... 439/74, 357, 345

See application file for complete search history.

(56) References Cited

U.S. PATENT DOCUMENTS

| | | | | |
|---|---|---|---|---|
| 7,128,581 | B2 * | 10/2006 | Igarashi et al. | 439/74 |
| 7,658,636 | B2 * | 2/2010 | Takeuchi et al. | 439/357 |
| 7,845,958 | B2 * | 12/2010 | Hoshino et al. | 439/74 |

(Continued)

FOREIGN PATENT DOCUMENTS

| | | | |
|---|---|---|---|
| JP | 2003-163054 | A | 6/2003 |
| KR | 20090117979 | A | 11/2009 |

OTHER PUBLICATIONS

Korean Office Action dated Apr. 27, 2015, in connection with KR Application No. 10-2014-0015021 (7 pages, English translation of relevant part provided).

*Primary Examiner* — Abdullah Riyami
*Assistant Examiner* — Vladimir Imas
(74) *Attorney, Agent, or Firm* — Maier & Maier, PLLC

(57) ABSTRACT

A plug includes a plurality of plug contacts arranged in a row and a plug housing. The plurality of plug contacts each include first bending portion and the like. The first bending portions and the like are aligned in a direction where the plurality of plug contacts are arranged. The receptacle includes second metal parts and a receptacle housing. When the plug and the receptacle are mated, the plurality of plug contacts of the plug are brought into contact with the plurality of respective second metal parts of the receptacle. When the plug contacts are brought into contact with the respective second metal parts, each of the second metal parts exerts a resistance force against pull-out of the plug from the receptacle. An auxiliary metal fitting exerts a resistance force with different magnitude from the magnitude of the receptacle contact.

16 Claims, 25 Drawing Sheets

(56) References Cited

U.S. PATENT DOCUMENTS

| | | | | |
|---|---|---|---|---|
| 7,901,218 | B2 * | 3/2011 | Sato et al. | 439/74 |
| 8,052,457 | B2 * | 11/2011 | Miyazaki et al. | 439/357 |
| 8,292,635 | B2 * | 10/2012 | Little et al. | 439/74 |
| 8,408,931 | B2 * | 4/2013 | Sato et al. | 439/357 |
| 8,485,832 | B2 * | 7/2013 | Mashiyama et al. | 439/74 |
| 8,556,640 | B2 * | 10/2013 | Mashiyama et al. | 439/74 |
| 8,840,407 | B2 * | 9/2014 | Nose et al. | 439/74 |
| 2009/0280658 | A1 | 11/2009 | Hoshino | |

* cited by examiner

RELATED ART

CONNECTOR WITH ADJUSTABLE LOCKING FORCE

INCORPORATION BY REFERENCE

This application is based upon and claims the benefit of priority from Japanese patent application No. 2013-051976, filed on Mar. 14, 2013, and Japanese patent application No. 2013-200128, filed on Sep. 26, 2013, the disclosure of which is incorporated herein in its entirety by reference.

BACKGROUND OF THE INVENTION

1. Field of the Invention

The present invention relates to a connector.

2. Description of Related Art

As a technique of this type, Japanese Unexamined Patent Application Publication No. 2003-163054 discloses a connector apparatus 102 including a connector 100 and a mating connector 101, as shown in FIG. 17 of the present invention. The connector 100 includes a plurality of contacts 103 arranged in two rows and an insulator 104 that holds the plurality of contacts 103. The mating connector 101 includes a plurality of mating contacts 105 arranged in two rows and a mating insulator 106 that holds the plurality of mating contacts 105. When the connector 100 and the mating connector 101 are mated, the plurality of contacts 103 and the plurality of respective mating contacts 105 are elastically brought into contact.

Locking means is formed to each contact 103 and the corresponding mating contact 105 against pull-out of the mating connector 101 from the connector 100 when the connector 100 and the mating connector 101 are in a mated state.

SUMMARY OF THE INVENTION

With the configuration disclosed in Unexamined Patent Application Publication No. 2003-163054, the locking force as the resistance force against the pull-out of the mating connector 101 from the connector 100 is determined according to the number of the contacts 103 and the mating contacts 105. However, as the number of the contacts 103 and the mating contacts 105 varyingly increases or decreases according to the use of the connector apparatus 102, the locking force increases or decreases accordingly for every apparatus with the configuration disclosed in Unexamined Patent Application Publication No. 2003-163054. That is, with the configuration disclosed in Unexamined Patent Application Publication No. 2003-163054, it has been difficult to independently adjust the locking force.

In order to address this issue, a metal part dedicated for the locking force can further be provided to the mating connector 101, however this would increase the manufacturing cost of the mating connector 101.

Thus, an object of the present invention is to provide a technique to realize ease of adjusting the locking force while reducing the manufacturing cost of the mating connector.

An exemplary aspect of the present invention is a connector including: a first connector part that includes a plurality of first metal parts arranged in a row and a first housing holding the plurality of first metal parts by insert molding, the plurality of first metal parts each having at least one bending portion, and the bending portions of the plurality of first metal parts being aligned in a direction where the plurality of first metal parts are arranged; and a second connector part that includes a plurality of second metal parts and a second housing holding the plurality of second metal parts. When the first connector part and the second connector part are mated, the plurality of first metal parts of the first connector part are brought into contact with the plurality of respective second metal parts of the second connector part. When the first metal parts are brought into contact with the respective second metal parts, each of the second metal parts exerts a resistance force against pull-out of the first connector part from the second connector part. Further, a magnitude of the resistance force of a special metal part as one of the plurality of second metal parts of the second connector part is configured to be different from a magnitude of the resistance force of a normal metal part as the second metal part other than the special metal part.

The plurality of first metal parts of the first connector part have an identical shape.

A thickness of a portion of the special metal part exerting the resistance force is different from a thickness of a portion of the normal metal part exerting the resistance force.

A width of a portion of the special metal part exerting the resistance force is different from a width of a portion of the normal metal part exerting the resistance force.

A material of a portion of the special metal part exerting the resistance force is different from a material of a portion of the normal metal part exerting the resistance force.

The second connector part is mounted on a substrate. The special metal part includes: a lock protuberance holding portion; an interference portion that is formed to extend from the lock protuberance holding portion; a lock protuberance that is formed to the lock protuberance holding portion and hooks on the first connector part to exert the resistance force; and a displacement restricting portion that is disposed opposite to the substrate in a view from the interference portion and is also fixed to the substrate.

The second connector part is mounted on a substrate. The special metal part includes: a displacement forbidden portion that is fixed to the substrate to be forbidden from being displaced on the substrate; an easy-to-deform portion that is formed in a beam shape extending from the displacement forbidden portion to enable easy deformation, and a displacement allowed portion that is supported by the displacement forbidden portion with the easy-to-deform portion interposed therebetween. The displacement allowed portion includes: a contacting portion that can be in contact with the first metal part, a holding portion that holds the contacting portion, and an interference portion that can be in contact with the displacement forbidden portion in a pull-out direction that is a direction to pull out the first connector part from the second connector part.

When the contacting portion of the displacement allowed portion is brought into contact with the first metal part, the special metal part exerts the resistance force, and when the interference portion is brought into contact with the displacement forbidden portion in the pull-out direction, displacement of the displacement allowed portion in the pull-out direction is restricted.

A thickness direction of the interference portion is a direction substantially orthogonal to the pull-out direction.

The displacement forbidden portion includes a displacement restricting portion to be in contact with the interference portion in the pull-out direction. A thickness direction of the displacement restricting portion is a direction substantially orthogonal to the pull-out direction.

The thickness direction of the interference portion and the thickness direction of the displacement restricting portion are different in a view of the pull-out direction.

The thickness direction of the interference portion is substantially parallel to the pull-out direction According to the present invention, the necessary resistance force between the first connector part and the second connector part can be adjusted by the special metal part. Moreover, the plurality of first metal parts are connected to each other and can be transported at the same time by one carrier. Therefore, the first connector part can be manufactured at a low cost.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Embodiment

Figure 1:
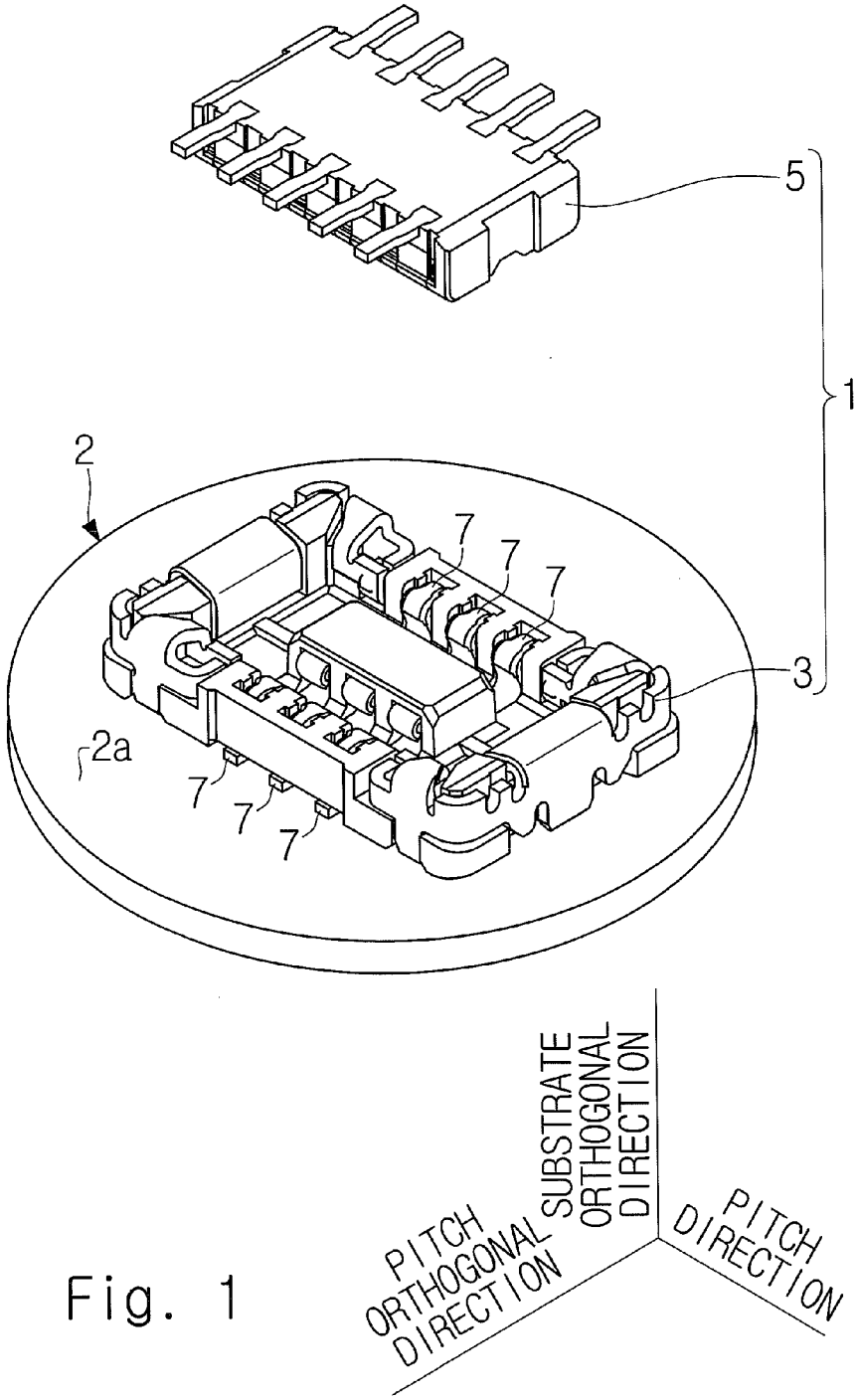
FIG. 1 is a perspective view showing a state before a board-to-board connector is mated (a first embodiment)
Figure 2:
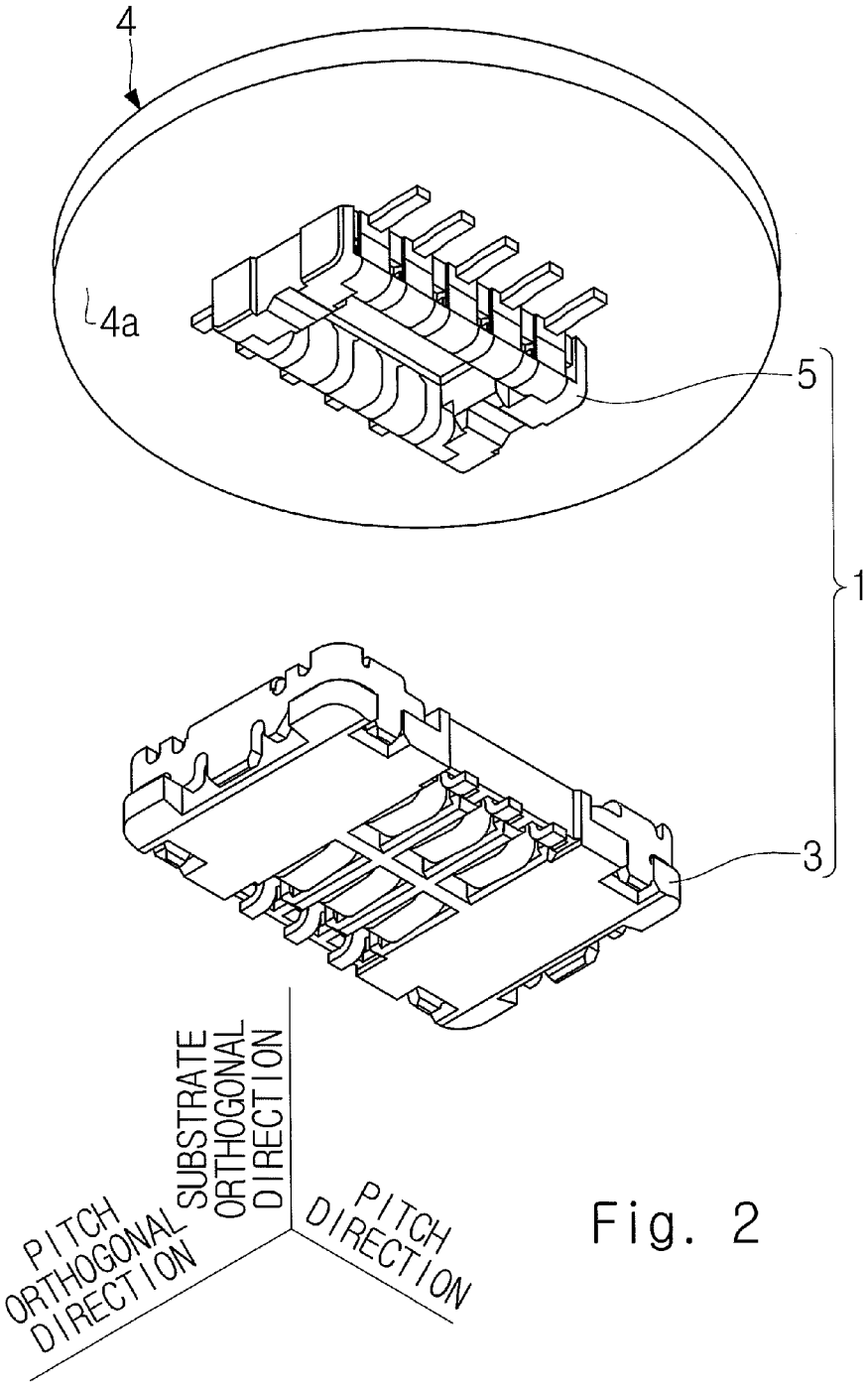
FIG. 2 is a perspective view showing the state before the board-to-board connector is mated viewed from another angle (the first embodiment)

As shown in FIGS. 1 and 2, a board-to-board connector 1 includes a receptacle 3 (a second connector part) to be mounted on a connector mounting surface 2*a* of a receptacle-side substrate 2 (a second substrate, a substrate) and a plug 5 (a first connector part) to be mounted on a connector mounting surface 4*a* of a plug-side substrate 4 (a first substrate). The board-to-board connector 1 electrically connects the connector mounting surface 2*a* of the receptacle-side substrate 2 and the connector mounting surface 4*a* of the plug-side substrate 4. Specifically, when the plug 5 is mated with the receptacle 3, the connector mounting surface 2*a* of the receptacle-side substrate 2 is electrically connected to the connector mounting surface 4*a* of the plug-side substrate 4.

(Receptacle 3)

Figure 3:
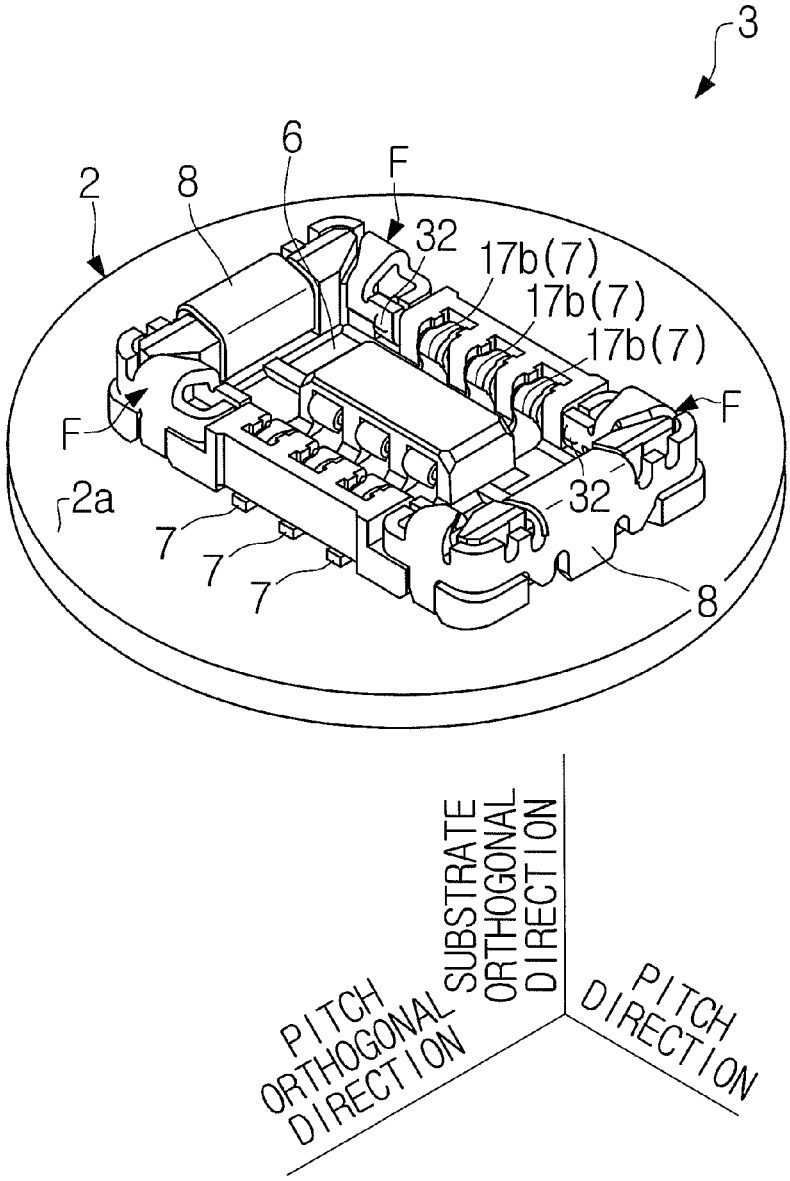
FIG. 3 is a perspective view of a receptacle (the first embodiment)
Figure 4:
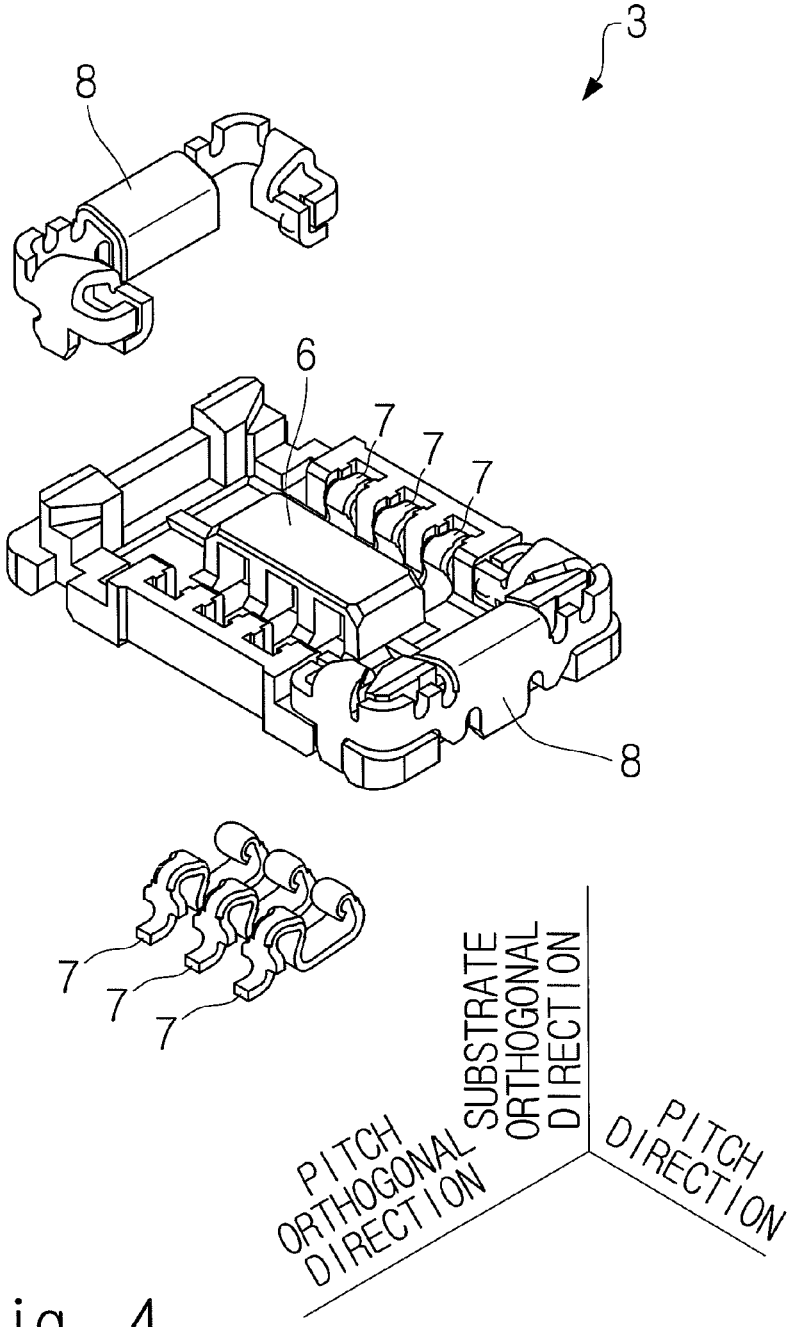
FIG. 4 is an exploded perspective view of the receptacle (the first embodiment)

As shown in FIGS. 3 and 4, the receptacle 3 includes a receptacle housing 6 (a second housing), a plurality of receptacle contacts 7 (second metal parts; normal metal parts; second contacts), and a pair of auxiliary metal fittings 8 (second metal parts; special metal parts). The receptacle housing 6 holds the plurality of receptacle contacts 7 and the pair of auxiliary metal fittings 8. As shown in FIG. 1, the plurality of receptacle contacts 7 are arranged in two rows. The plurality of receptacle contacts 7 in each of the two rows are arranged at regular intervals in a direction parallel to the connector mounting surface 2*a* of the receptacle-side substrate 2.

Referring now to FIG. 1, the terms "pitch direction", "pitch orthogonal direction", and "substrate orthogonal direction" are defined. The term "pitch direction" refers to a direction which is parallel to the connector mounting surface 2*a* of the receptacle-side substrate 2 and in which the plurality of receptacle contacts 7 are arranged in two rows. In the "pitch direction", a direction approaching the center of the receptacle 3 is defined as a "pitch center direction" and a direction away from the center of the receptacle 3 is defined as a "pitch anti-center direction". The term "pitch orthogonal direction" refers to a direction which is parallel to the connector mounting surface 2*a* of the receptacle-side substrate 2 and which is orthogonal to the pitch direction. In the "pitch orthogonal direction", a direction approaching the center of the receptacle 3 is defined as a "pitch orthogonal center direction", and a direction away from the center of the receptacle 3 is defined as a "pitch orthogonal anti-center direction". The term "substrate orthogonal direction" is a direction orthogonal to the connector mounting surface 2*a* of the receptacle-side substrate 2. In the "substrate orthogonal direction", a direction approaching the connector mounting surface 2*a* of the receptacle-side substrate 2 is defined as a "substrate approaching direction", and a direction away from the connector mounting surface 2*a* of the receptacle-side substrate 2 is defined as a "substrate away direction". The substrate away direction corresponds to a pull-out direction that is a direction to pull out the plug 5 from the receptacle 3. The pitch direction, the pitch orthogonal direction, and the substrate orthogonal direction are orthogonal to one another. The pitch direction, the pitch orthogonal direction, and the substrate orthogonal direction defined as above in FIG. 1 shall be used as they are also in the explanation of the plug 5. Specifically, in the explanation of the plug 5, please keep in mind that the substrate approaching direction and the substrate away direction are defined based on the connector mounting surface 2*a* of the receptacle-side substrate 2 and not based on the connector mounting surface 4*a* of the plug-side substrate 4.

Figure 5:
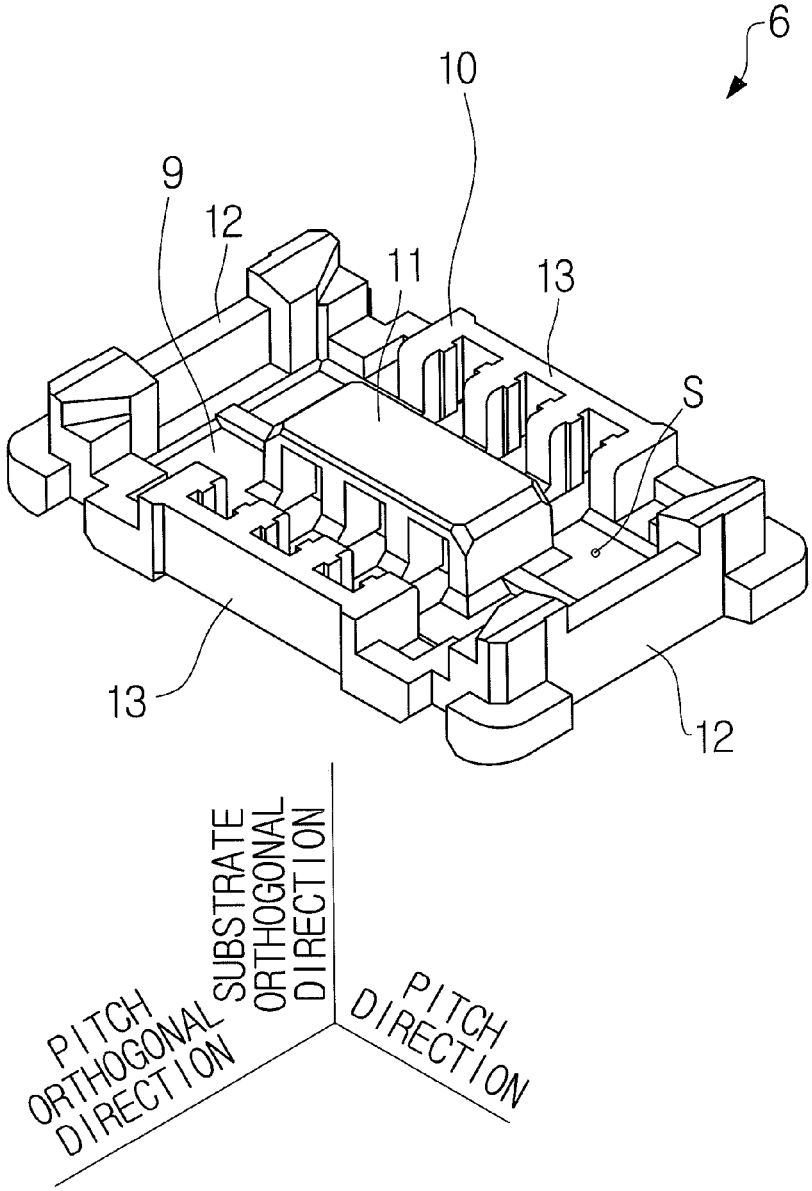
FIG. 5 is a perspective view of a receptacle housing (the first embodiment)

As shown in FIG. 5, the receptacle housing 6 has a bottom plate 9, a peripheral wall 10, and a central protuberance 11.

The bottom plate 9 is parallel to the connector mounting surface 2*a* of the receptacle-side substrate 2.

The peripheral wall 10 is formed protruding from the bottom plate 9 toward the substrate away direction. The peripheral wall 10 is formed in a rectangular annular shape. The peripheral wall 10 has a pair of auxiliary side walls 12 and a pair of contact side walls 13. The pair of auxiliary side walls 12 holds the pair of auxiliary metal fittings 8. The pair of auxiliary side walls 12 is arranged to face each other in the pitch direction. The pair of contact side walls 13 holds the plurality of receptacle contacts 7. The pair of contact side walls 13 is arranged to face each other in the pitch orthogonal direction.

The central protuberance 11 is formed protruding from the bottom plate 9 toward the substrate away direction. The central protuberance 11 is disposed at the center of the bottom plate 9.

With the above configuration, a rectangular annular plug accommodating space S is formed between the peripheral wall 10 and the central protuberance 11.

Figure 6:
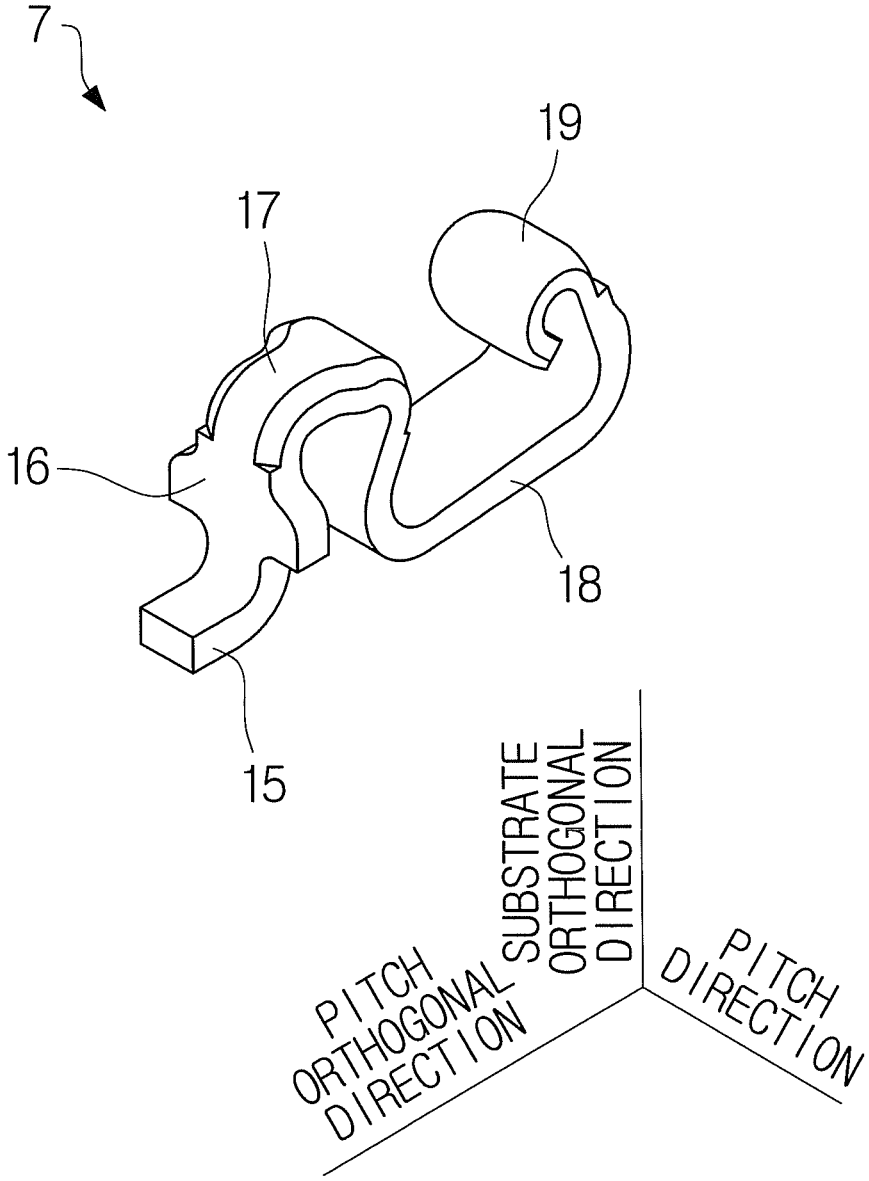
FIG. 6 is a perspective view of a receptacle contact (the first embodiment)
Figure 7:
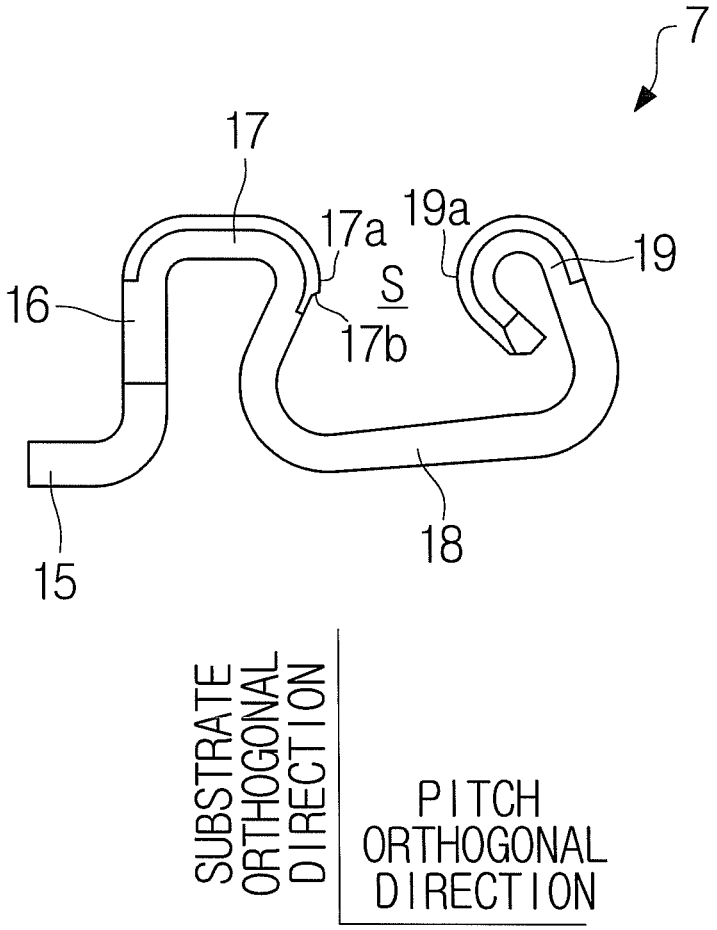
FIG. 7 is a side view of the receptacle contact (the first embodiment)

As shown in FIGS. 6 and 7, the receptacle contact 7 has a substrate fixing portion 15, a held portion 16, an outer contact point portion 17, a contact point connecting portion 18, and an inner contact point portion 19. The substrate fixing portion 15, the held portion 16, the outer contact point portion 17, the contact point connecting portion 18, and the inner contact point portion 19 are continuous in this order.

The substrate fixing portion 15 is mechanically and electrically fixed to the connector mounting surface 2*a* of the receptacle-side substrate 2 by soldering thereto. The substrate fixing portion 15 is formed to extend toward the pitch orthogonal direction.

The held portion 16 is held by press-fit into the receptacle housing 6. The held portion 16 is formed to extend from an end of the substrate fixing portion 15 in the pitch orthogonal center direction toward the substrate away direction.

The outer contact point portion 17 functions as a contact point with the plug 5. The outer contact point portion 17 is formed to extend from an end of the held portion 16 in the substrate away direction toward the pitch orthogonal center direction and also formed to extend toward the substrate approaching direction with a slight inclination toward the pitch orthogonal anti-center direction. The outer contact point portion 17 is formed curving to protrude toward the pitch orthogonal center direction. The outer contact point portion 17 has an outer contact point 17*a* and a hooking portion 17*b*. The outer contact point 17*a* is positioned at the pitch orthogonal center direction-side end of the outer contact point portion 17. The hooking portion 17*b* is positioned at a place farther in the substrate approaching direction than the outer contact point 17*a*. The hooking portion 17*b* is formed in a step shape.

The contact point connecting portion 18 connects between the outer contact point portion 17 and the inner contact point portion 19. The contact point connecting portion 18 is formed to extend from an end of the outer contact point portion 17 in the substrate approaching direction toward the pitch orthogonal center direction.

The inner contact point portion 19 functions as a contact point with the plug 5. The inner contact point portion 19 is formed to extend from an end of the contact point connecting portion 18 in the pitch orthogonal center direction toward the substrate away direction with a slight inclination toward the pitch orthogonal anti-center direction and also formed to extend toward the substrate approaching direction protruding toward the pitch orthogonal anti-center direction. The inner contact point portion 19 has an inner contact point 19*a*. The inner contact point 19*a* is positioned at the pitch orthogonal anti-center direction-side end of the inner contact point portion 19.

As shown in FIG. 7, the outer contact point 17*a* of the outer contact point portion 17 and the inner contact point 19*a* of the inner contact point portion 19 face each other in the pitch orthogonal direction with the plug accommodating space S interposed therebetween.

Figure 8:
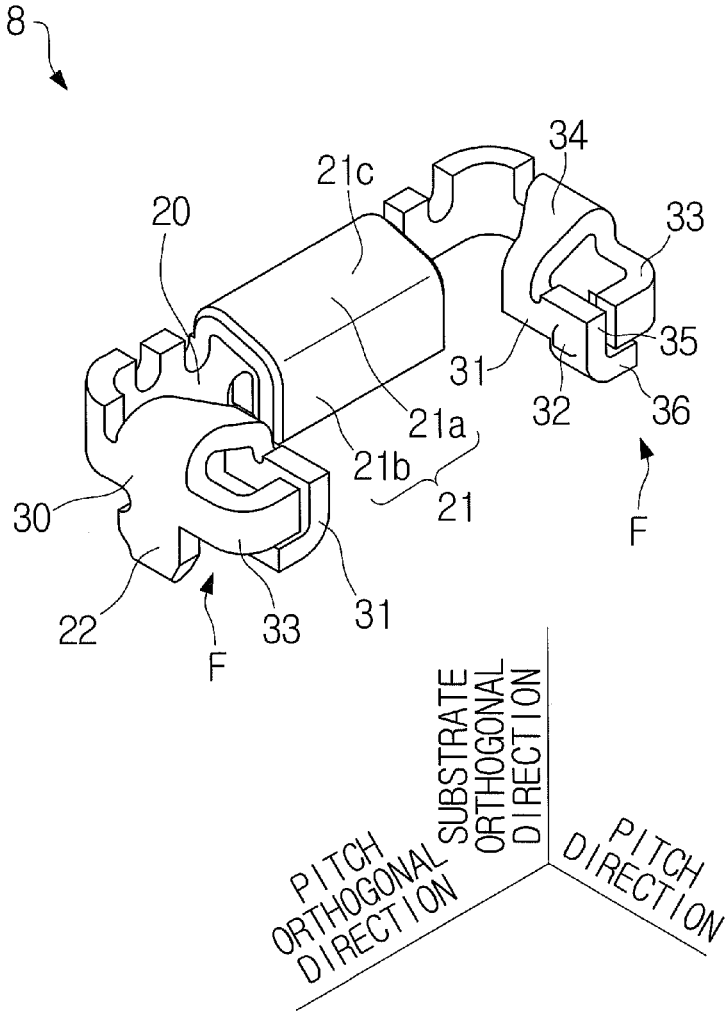
FIG. 8 is a perspective view of an auxiliary metal fitting (the first embodiment)
Figure 9:
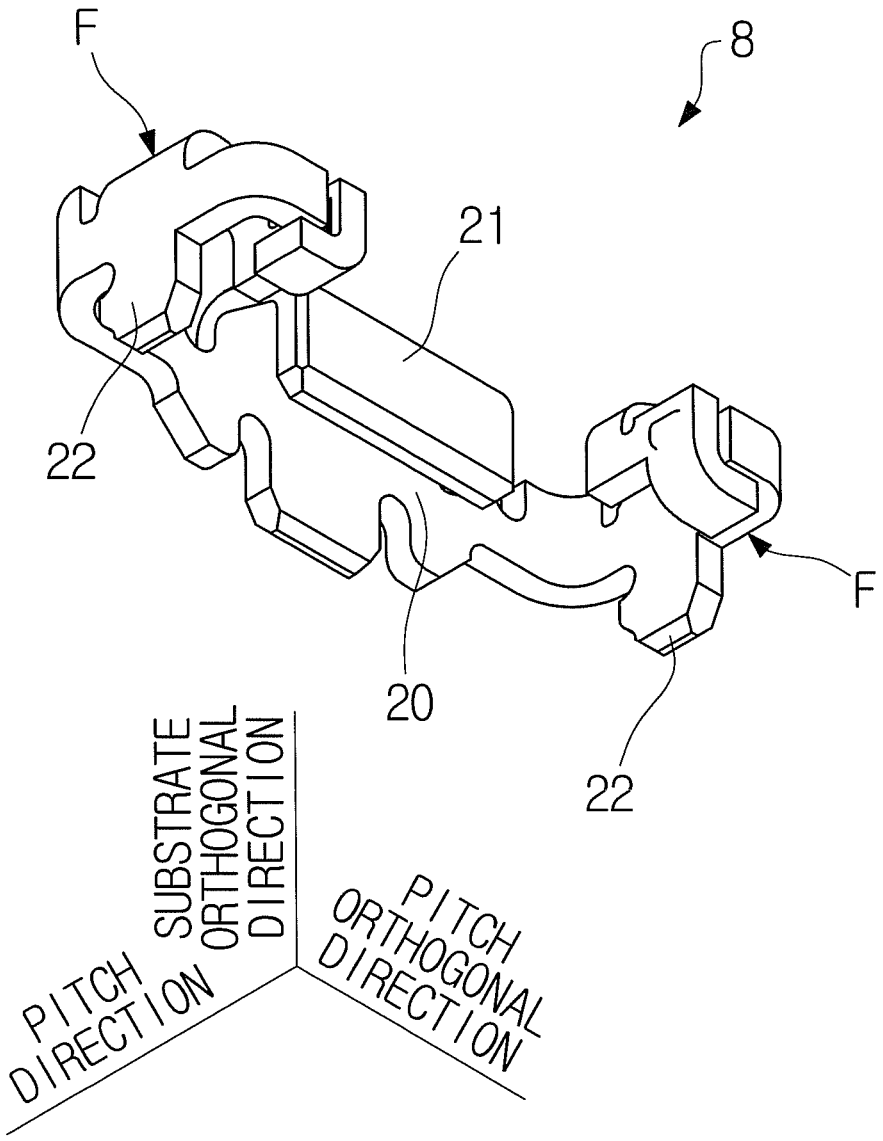
FIG. 9 is a perspective view of the auxiliary metal fitting viewed from another angle (the first embodiment)
Figure 10:
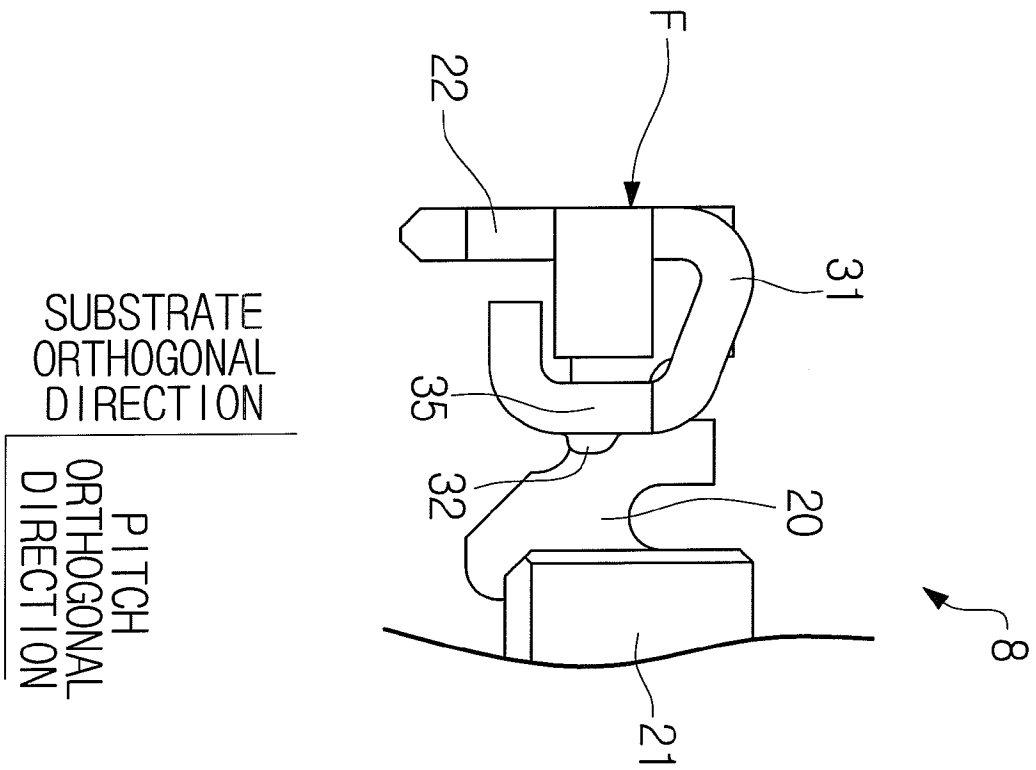
FIG. 10 is a fragmentary perspective view of the auxiliary metal fitting (the first embodiment)

As shown in FIGS. 8 to 10, the auxiliary metal fitting 8 has an auxiliary metal fitting body 20, a guide 21, a pair of locking mechanisms F, and a pair of fixed parts 22.

The auxiliary metal fitting body 20 is formed to extend toward the pitch orthogonal direction.

The guide 21 aligns the plug 5 with the receptacle 3 in the pitch direction when the plug 5 is mated with the receptacle 3. The guide 21 has a straight inclined portion 21*a* and a straight vertical portion 21*b*. At the center of the auxiliary metal fitting body 20 in the pitch orthogonal direction, the straight inclined portion 21*a* is formed to extend from an end of the auxiliary metal fitting body 20 in the substrate away direction toward the pitch center direction with a slight inclination toward the substrate approaching direction. The straight inclined portion 21*a* has a flat guiding surface 21*c*. The straight vertical portion 21*b* is formed to extend from an end of the straight inclined portion 21*a* in the pitch center direction toward the substrate approaching direction.

The pair of locking mechanisms F is formed to protrude from both ends of the auxiliary metal fitting body 20 in the pitch orthogonal direction toward the pitch center direction. Since the pair of locking mechanisms F has a symmetrical shape, only one of the locking mechanisms F is explained and the explanation of the other locking mechanism shall not be provided.

The locking mechanism F has a base 30, a lock spring piece 31, a lock protuberance 32, and a displacement restricting portion 33.

The base 30 is formed to extend from an end of the auxiliary metal fitting body 20 in the pitch orthogonal anti-center direction toward the pitch center direction.

The lock spring piece 31 elastically supports the lock protuberance 32 to enable elastic displacement of the lock protuberance 32 in the pitch orthogonal direction. The lock spring piece 31 is formed to extend from an end of the base 30 in the substrate away direction toward the pitch orthogonal center direction. To be more specific, the lock spring piece 31 has a spring piece body 34, a lock protuberance holding portion 35, and an interference portion 36. The spring piece body 34 is formed to extend from the end of the base 30 in the substrate away direction toward the pitch orthogonal center direction with a slight inclination toward the substrate approaching direction. The lock protuberance holding portion 35 is formed to extend from an end of the spring piece body 34 toward the pitch center direction. The interference portion 36 is formed to extend from an end of the lock protuberance holding portion 35 in the substrate approaching direction toward the pitch orthogonal anti-center direction.

The lock protuberance 32 hooks on the plug 5, thereby exerting the auxiliary metal fitting locking force as a part of the connector locking force, which is the resistance force against pull-out of the plug 5 from the receptacle 3. As shown in FIG. 10, the lock protuberance 32 is formed to protrude from the lock protuberance holding portion 35 toward the pitch orthogonal center direction.

The displacement restricting portion 33 restricts excessive displacement of the lock protuberance 32 toward the pitch orthogonal anti-center direction and the substrate away direction. As shown in FIG. 8, the displacement restricting portion 33 is formed to extend from the base 30 toward the pitch center direction and also formed to extend toward the pitch orthogonal center direction. The displacement restricting portion 33 is disposed on the side of the pitch orthogonal anti-center direction when viewed from the lock protuberance holding portion 35 of the lock spring piece 31 and faces the lock protuberance holding portion 35 of the lock spring piece 31 in the pitch orthogonal direction. With this configuration, the displacement restricting portion 33 restricts the excessive displacement of the lock protuberance 32 toward the pitch orthogonal anti-center direction. Similarly, the displacement restricting portion 33 is disposed on the side of the substrate away direction when viewed from the interference portion 36 of the lock spring piece 31 and faces the interference portion 36 of the lock spring piece 31 in the substrate orthogonal direction. With this configuration, the displacement restricting portion 33 restricts the excessive displacement of the lock protuberance 32 toward the substrate away direction.

The pair of fixed portions 22 fixes the receptacle housing 6 to the connector mounting surface 2*a* of the receptacle-side substrate 2. Each fixed portion 22 is formed to extend from an end of corresponding base 30 in the substrate approaching direction toward the substrate approaching direction. Each fixed portion 22 is press-fit into the receptacle housing 6 and also fixed to the connector mounting surface 2*a* of the receptacle-side substrate 2 by soldering thereto.

With the above configuration, as shown in FIG. 3, the lock protuberance 32 of one of the locking mechanisms F of one of the auxiliary metal fittings 8, the lock protuberance 32 of one of the locking mechanisms F of the other auxiliary metal fitting 8, and the hooking portions 17*b* of the plurality of receptacle contacts 7 that are arranged in one of the rows are placed in a line in the pitch direction at certain intervals. The lock protuberance 32 of one of the locking mechanisms F of one of the auxiliary metal fittings 8 and the lock protuberance 32 of one of the locking mechanisms F of the other auxiliary metal fitting 8 are arranged to sandwich, in the pitch direction, the hooking portions 17*b* of the plurality of receptacle contacts 7 that are arranged in one of the rows. The other locking mechanism F has the same configuration as above.

(Plug 5)

Figure 11:
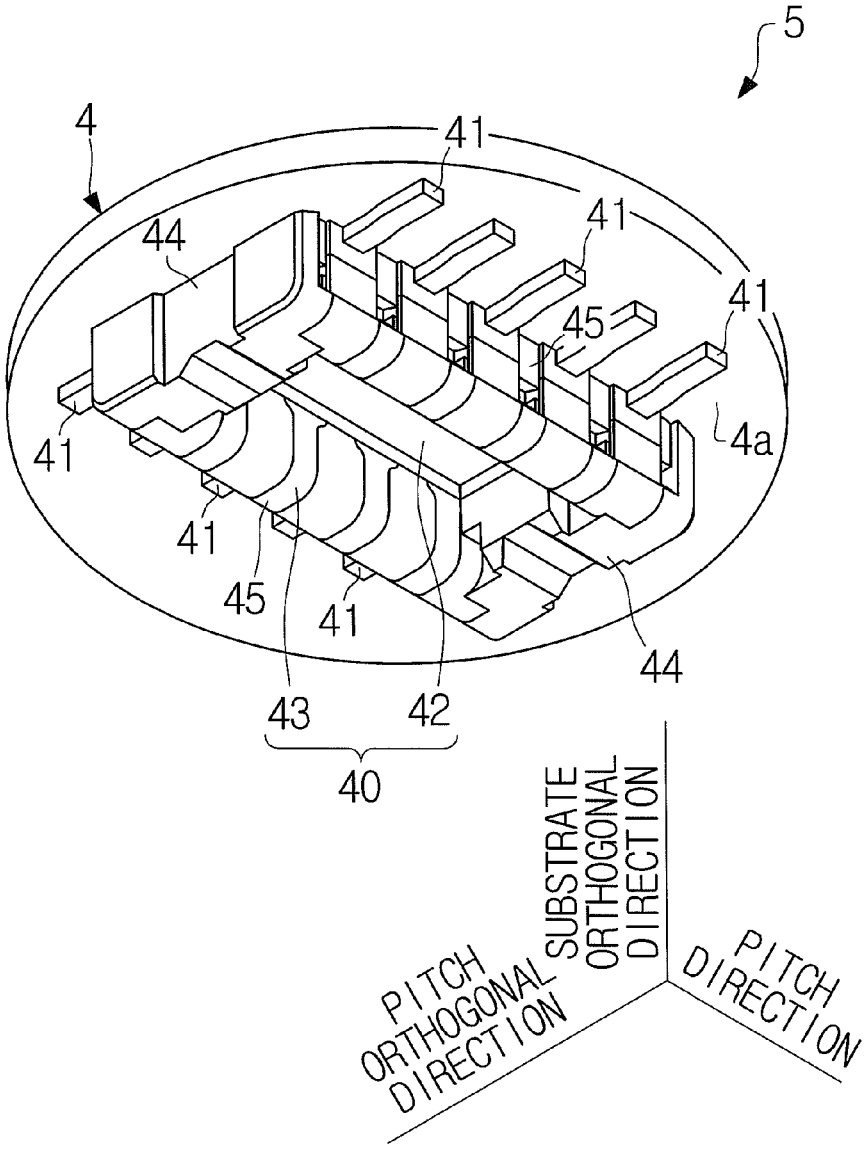
FIG. 11 is a perspective view of a plug (the first embodiment)

As shown in FIG. 11, the plug 5 includes a plug housing 40 (a first housing) and a plurality of plug contacts 41 (first metal parts; first contacts). The plug housing 40 holds the plurality of plug contacts 41 by insert molding. The plurality of plug contacts 41 are arranged in two rows in the pitch direction. All of the plurality of plug contacts 41 have an identical shape.

The plug housing 40 has a bottom plate 42 and a peripheral wall 43.

The bottom plate 42 is parallel to the connector mounting surface 4*a* of the plug-side substrate 4.

The peripheral wall 43 is formed to protrude from the bottom plate 42 toward the substrate approaching direction. The peripheral wall 43 is formed in a rectangular annular shape. The peripheral wall 43 has a pair of auxiliary side walls 44 and a pair of contact side walls 45. The pair of auxiliary side walls 44 is arranged to face each other in the pitch direction. The pair of contact side walls 45 holds the plurality of plug contacts 41. The pair of contact side walls 45 is arranged to face each other in the pitch orthogonal direction.

Figure 12:
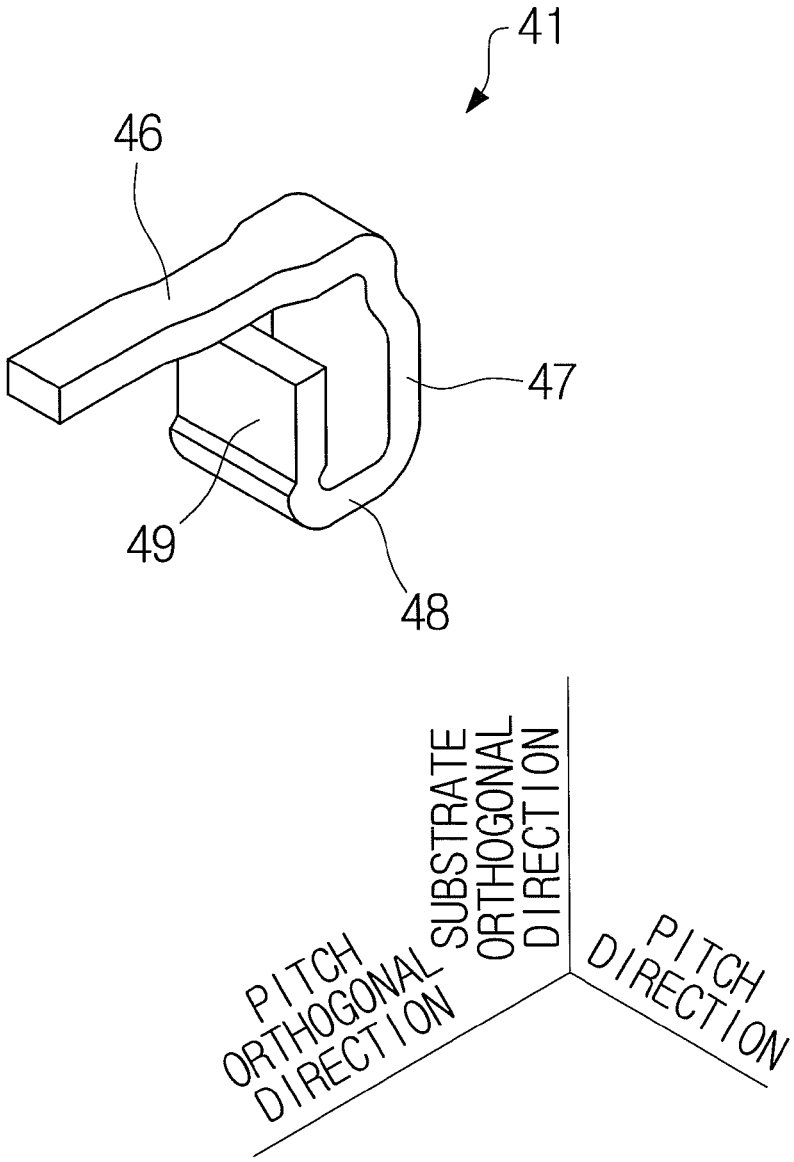
FIG. 12 is a perspective view of a plug contact (the first embodiment)
Figure 13:
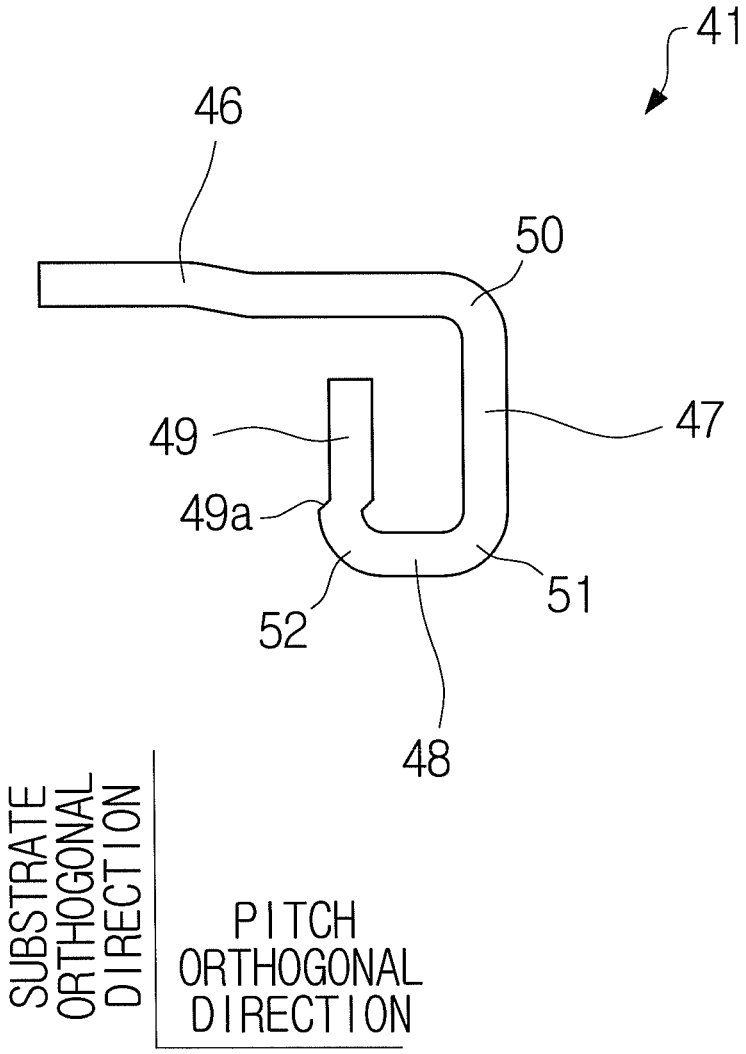
FIG. 13 is a side view of the plug contact (the first embodiment)

As shown in FIGS. 12 and 13, the plug contact 41 has a substrate fixing portion 46, an inner contact point portion 47, a contact point connecting portion 48, and an outer contact point portion 49. The substrate fixing portion 46, the inner contact point portion 47, the contact point connecting portion 48, and the outer contact point portion 49 are continuous in this order.

The substrate fixing portion 46 is mechanically and electrically fixed to the connector mounting surface 4*a* of the plug-side substrate 4 by soldering thereto. The substrate fixing portion 46 is formed to extend in the pitch orthogonal direction.

The inner contact point portion 47 functions as a contact point with the receptacle 3. The inner contact point portion 47 is formed to extend from an end of the substrate fixing portion 46 in the pitch orthogonal center direction toward the substrate approaching direction.

The contact point connecting portion 48 connects the inner contact point portion 47 and the outer contact point portion 49 to each other. The contact point connecting portion 48 is formed to extend from an end of the inner contact point portion 47 toward the pitch orthogonal anti-center direction.

The outer contact point portion 49 functions as a contact point with the receptacle 3. The outer contact point portion 49 is formed to extend from an end of the contact point connecting portion 48 in the pitch orthogonal anti-center direction toward the substrate away direction. The outer contact point portion 49 has a hooking portion 49*a*. The hooking portion 49*a* is positioned at the substrate approaching direction-side end of the outer contact point portion 49. The hooking portion 49*a* is formed in a step shape.

Figure 14:
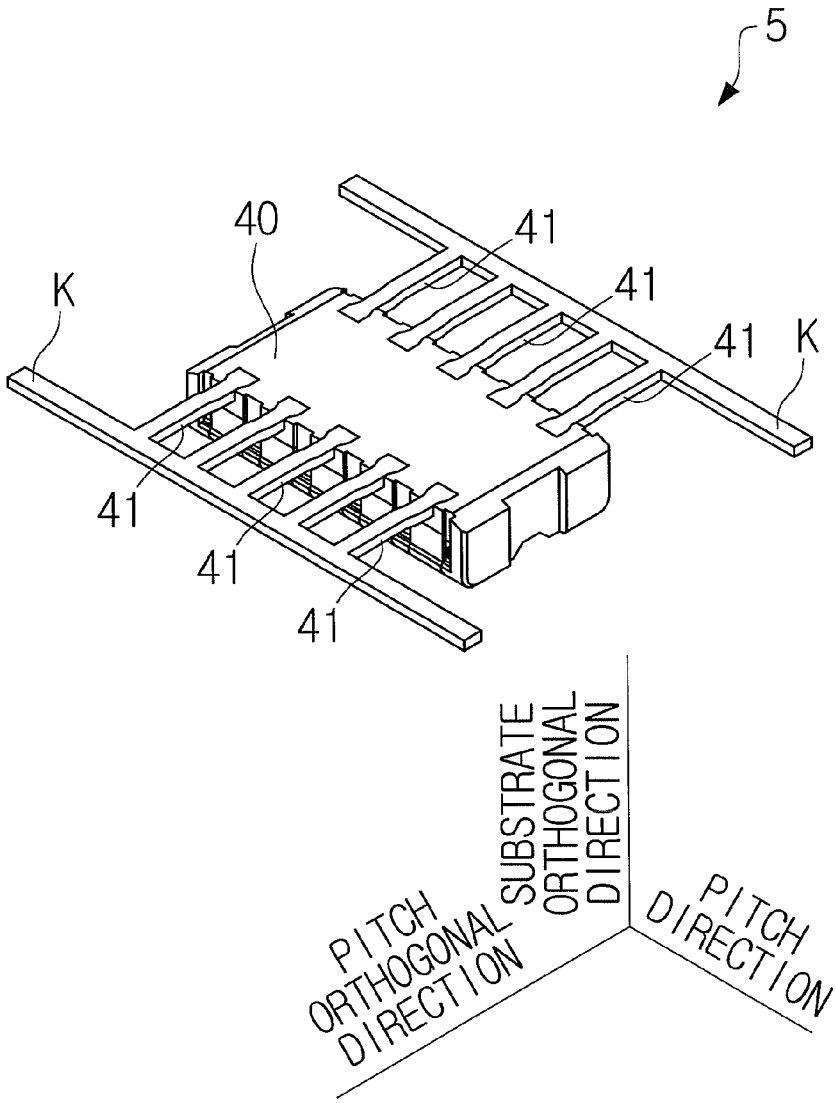
FIG. 14 is a drawing showing the plug in a manufacturing process (the first embodiment)

With the above configuration, the plug contact 41 has a first bending portion 50 (the bending portion), a second bending portion 51 (the bending portion), and a third bending portion 52 (the bending portion). The first bending portion 50 corresponds to a boundary between the substrate fixing portion 46 and the inner contact point portion 47 and bends substantially 90 degrees in a view of the pitch direction. The second bending portion 51 corresponds to a boundary between the inner contact point portion 47 and the contact point connecting portion 48 and bends substantially 90 degrees in a view of the pitch direction. The third bending portion 52 corresponds to a boundary between the contact point connecting portion 48 and the outer contact point portion 49 and bends substantially 90 degrees in a view of the pitch direction. Then, as shown in FIG. 11, in the state where the plurality of plug contacts 41 are held by the plug housing 40, the first bending portions 50, the second bending portions 51, and the third bending portions 52 of the plurality of plug contacts 41 in each row are aligned in the pitch direction respectively with the first bending portions 50, the second bending portions 51, and the third bending portions 52 of the other plug contacts 41 being in the same row. Therefore, as shown in FIG. 14, it becomes possible to mutually connect the plurality of plug contacts 41 in each row and to transport the plurality of plug contacts 41 at the same time by a single carrier K. This is advantageous for the manufacturing cost when the plug 5 is manufactured by insert molding. There are two reasons for this. First, in this exemplary embodiment, as shown in FIG. 14, the number of the carriers K is only two in total when the plug 5 is manufactured by insert molding, which means only a small number of parts is required. Second, as shown in FIG. 14, the carriers K do not physically interfere with each other when manufactured by insert molding, and it is thus easy to dispose the carriers K in a mold, thereby simplifying the mold design.

(Directions for Using the Board-to-Board Connector 1)

Next, the directions for using the board-to-board connector 1 are explained. First, as shown in FIG. 1, the receptacle 3 is mounted on the connector mounting surface 2*a* of the receptacle-side substrate 2. As shown in FIG. 2, the plug 5 is mounted on the connector mounting surface 4*a* of the plug-side substrate 4.

Then, as shown in FIGS. 1 and 2, the plug 5 is faced toward the receptacle 3 in the substrate orthogonal direction, and the plug-side substrate 4 is brought close to the receptacle-side substrate 2. At this time, the receptacle 3 and the plug 5 are both sandwiched between the receptacle-side substrate 2 and the plug-side substrate 4 and cannot be visually recognized directly. When the plug-side substrate 4 is brought close to the receptacle-side substrate 2, the auxiliary side wall 44 of the plug housing 40 of the plug 5 shown in FIG. 11 bumps against the guiding surface 21*c* of the straight inclined portion 21*a* of the guide 21 of the auxiliary metal fitting 8 shown in FIG. 8 and moves toward the pitch center direction along the inclination of the guiding surface 21*c*. Then, the receptacle 3 and the plug 5 are aligned in the pitch direction. Note that the alignment of the receptacle 3 and the plug 5 in the pitch orthogonal direction is performed by, for example, the spring piece body 34 of the lock spring piece 31 of the locking mechanism F of the auxiliary metal fitting 8 shown in FIG. 8

When the receptacle 3 and the plug 5 are aligned in the pitch direction and the pitch orthogonal direction as described above, the rectangular annular peripheral wall 43 of the plug housing 40 of the plug 5 shown in FIG. 11 is inserted in the rectangular annular plug accommodating space S of the receptacle housing 6 shown in FIG. 5.

Figure 15:
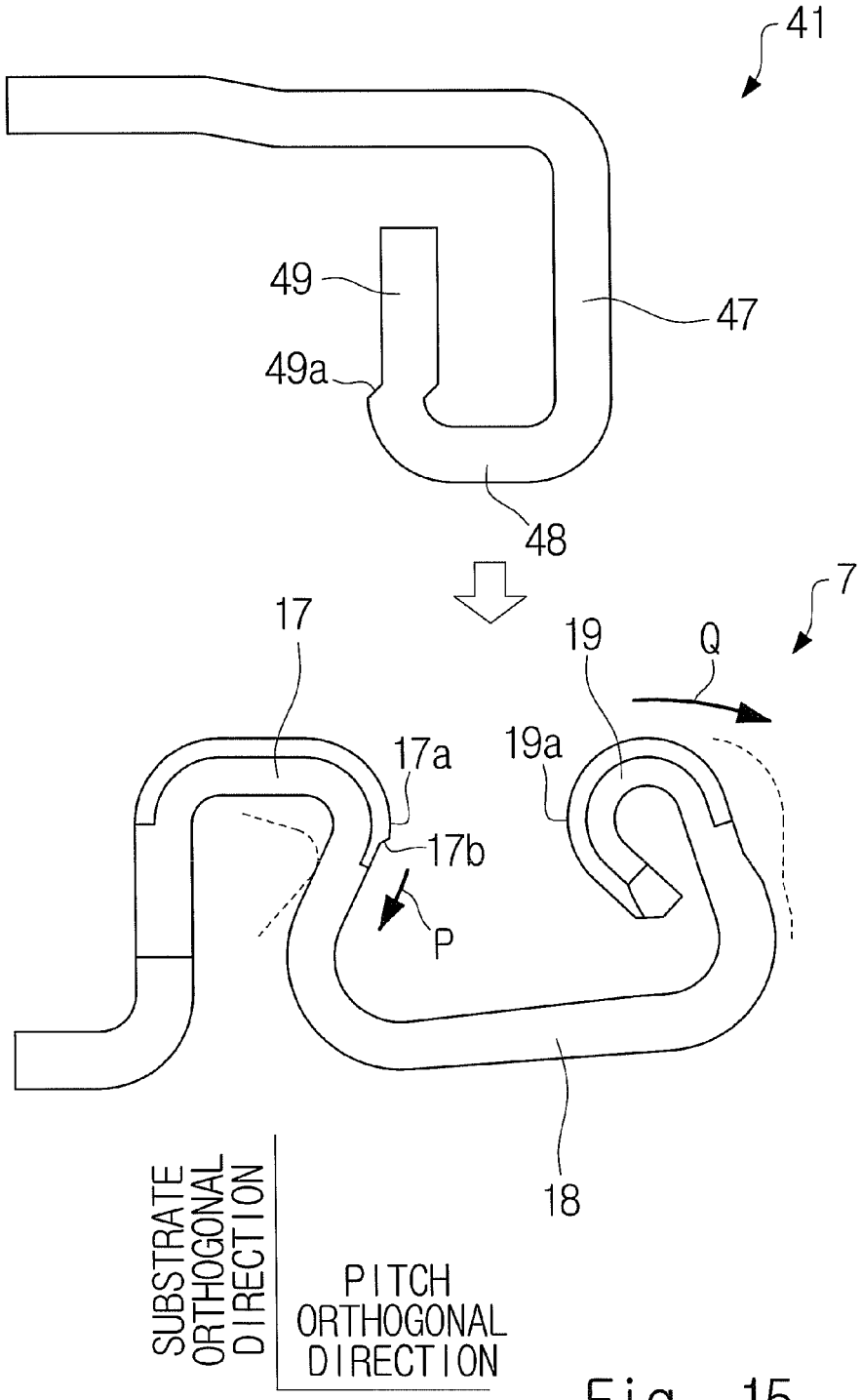
FIG. 15 is a drawing for explaining mating of the plug and the receptacle (the first embodiment)

Then, firstly, the inner contact point portion 47, the contact point connecting portion 48, and the outer contact point portion 49 of the plug contact 41 are inserted between the outer contact point portion 17 and the inner contact point portion 19 of the receptacle contact 7 while being elastically deformed as shown in FIG. 15. Specifically, the outer contact point portion 17 is elastically displaced in the substrate approaching direction and the pitch orthogonal anti-center direction, as indicated by the bold arrow P. The inner contact point portion 19 is elastically displaced in the pitch orthogonal center direction, as indicated by the bold arrow Q. Then, the outer contact point portion 17 and the inner contact point portion 19 slightly move away from each other in the pitch orthogonal direction, allowing the inner contact point portion 47, the contact point connecting portion 48, and the outer contact point portion 49 of the plug contact 41 to be inserted between the outer contact point portion 17 and the inner contact point portion 19 of the receptacle contact 7. Then, in time, when the hooking portion 49*a* of the outer contact point portion 49 of the plug contact 41 is positioned at a place farther in the substrate approaching direction than the hooking portion 17*b* of the outer contact point portion 17 of the receptacle contact 7, the outer contact point portion 49 of the plug contact 41 is brought into electrical contact with the outer contact point 17*a* of the outer contact point portion 17 of the receptacle contact 7. Similarly, the inner contact point portion 47 of the plug contact 41 is electrically brought into contact with the inner contact point 19*a* of the inner contact point portion 19 of the receptacle contact 7. In this state, when an attempt is made to pull out the plug 5 from the receptacle 3 in the substrate away direction, the hooking portion 49*a* of the outer contact point portion 49 of the plug contact 41 hooks on the hooking portion 17*b* of the outer contact point portion 17 of the receptacle contact 7, thereby exerting the contact locking force, which is the resistance force against the pull-out of the plug 5 from the receptacle 3.

Figure 16:
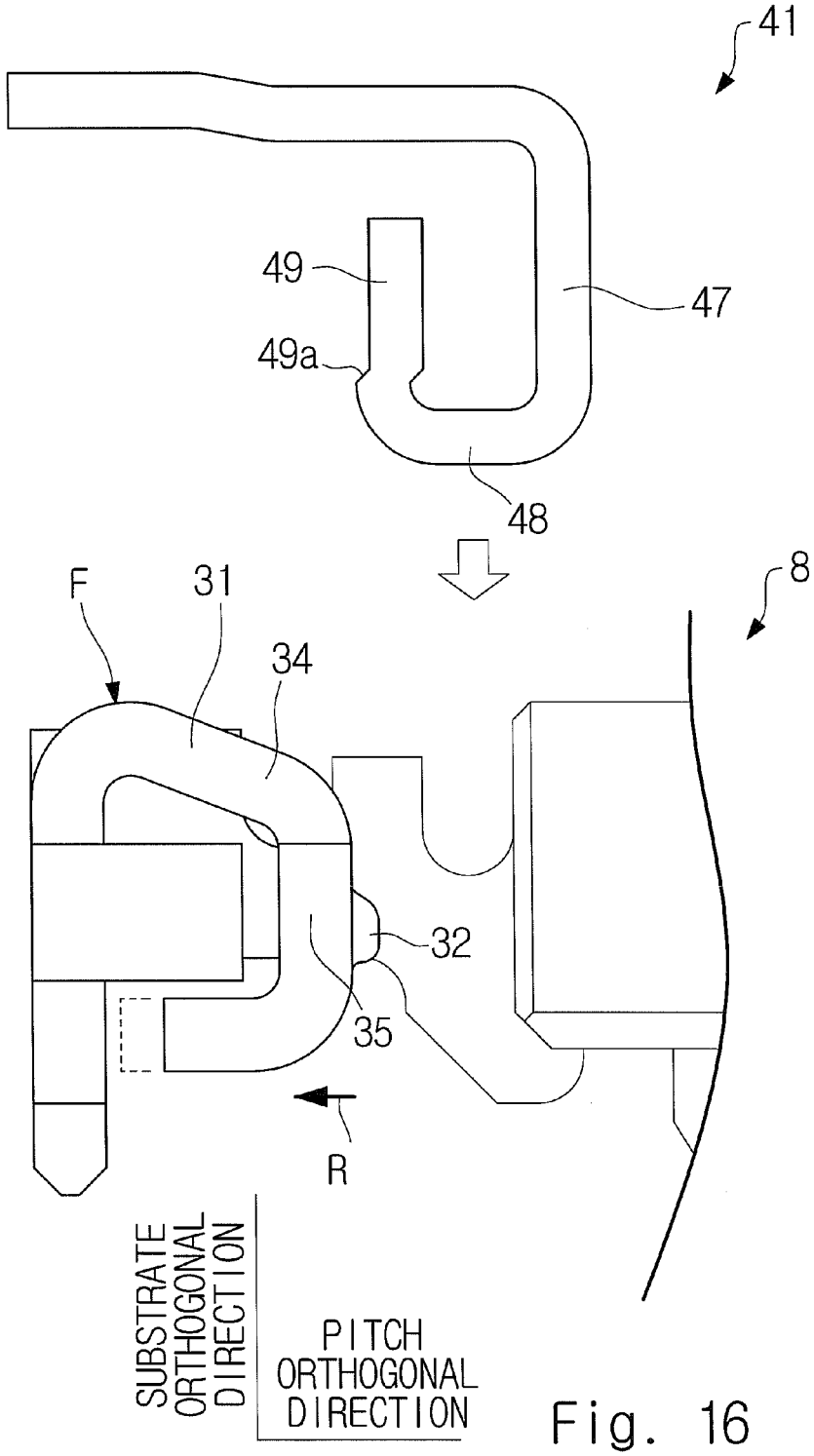
FIG. 16 is a drawing for explaining mating of the plug and the receptacle (the first embodiment)
Figure 17:
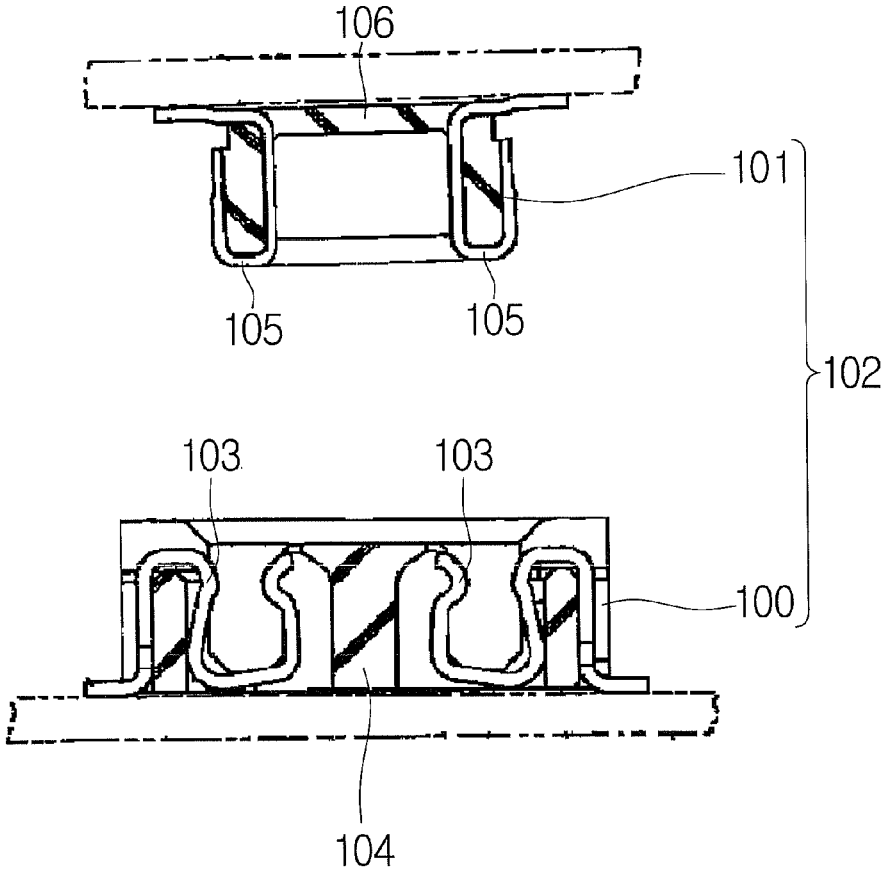
FIG. 17 is a drawing corresponding to FIG. 1 of Japanese Unexamined Patent Application Publication No. 2003-163054.

Moreover, secondly, as shown in FIG. 16, the outer contact point portion 49 of the plug contact 41 moves toward the substrate approaching direction and moves toward the pitch orthogonal center direction of the locking mechanism F of the auxiliary metal fitting 8 while the spring piece body 34 of the lock spring piece 31 of the locking mechanism F of the auxiliary metal fitting 8 is being elastically deformed. Specifically, the lock protuberance holding portion 35 is elastically displaced in the pitch orthogonal anti-center direction as indicated by the bold arrow R. This allows further movement of the outer contact point portion 49 of the plug contact 41 in the substrate approaching direction. Then, in time, when the hooking portion 49*a* of the outer contact point portion 49 of the plug contact 41 is positioned at a place farther in the substrate approaching direction than the lock protuberance 32 of the locking mechanism F of the auxiliary metal fitting 8, even when an attempt is made to pull out the plug 5 from the receptacle 3 in the substrate away direction, the hooking portion 49*a* of the outer contact point portion 49 of the plug contact 41 hooks on the lock protuberance 32 of the locking mechanism F of the auxiliary metal fitting 8, thereby exerting the auxiliary metal fitting locking force as a part of the connector locking force, which is the resistance force against the pull-out of the plug 5 from the receptacle 3.

As described above, as the connector locking force as the resistance force against the pull-out of the plug 5 from the receptacle 3, there is the contact locking force and auxiliary metal fitting locking force. That is, the connector locking force in this exemplary embodiment is a sum of the contact locking force at six positions and the auxiliary metal fitting locking force at four positions.

Here, in FIG. 15, the electrical contact between the plug contact 41 and the receptacle contact 7 must be secured. To that end, contact pressure of the plug contact 41 and the receptacle contact 7 should be adjusted as a top priority. Therefore, the above-mentioned contact locking force cannot be freely adjusted at all. Meanwhile, in FIG. 16, the plug contact 41 and the locking mechanism F of the auxiliary metal fitting 8 do not need to be in secured electrical contact. Therefore, the auxiliary metal fitting locking force can be adjusted freely.

Accordingly, in order to adjust the connector locking force as the resistance force against the pull-out of the plug 5 from the receptacle 3 to be a desired value, the auxiliary metal fitting locking force should be adjusted. For example, the auxiliary metal fitting locking force can be easily adjusted by appropriately changing the thickness and width and the material of the spring piece body 34 of the lock spring piece 31 of the auxiliary metal fitting 8. In this exemplary embodiment, as shown in FIGS. 15 and 16, the thickness of the spring piece body 34 of the lock spring piece 31 of the auxiliary metal fitting 8 is made greater than the thickness of the outer contact point portion 17 of the receptacle contact 7 to make it difficult for the lock protuberance 32 of the auxiliary metal fitting 8 to deviate in the pitch orthogonal anti-center direction, thereby making the auxiliary metal fitting lock force greater than the contact locking force.

Additionally, when the sum of the contact locking force becomes excessive by a number of pins, the connector locking force as the resistance force against the pull-out of the plug 5 from the receptacle 3 can be maintained to be constant, for example, by reducing the thickness of the auxiliary metal fitting 8 to be less than the thickness of the receptacle contact 7.

The exemplary embodiment of the present invention has been explained so far. The features of the above exemplary embodiment are explained as follows.

(1) The board-to-board connector 1 (the connector) includes the plug 5 (the first connector part) and the receptacle 3 (the second connector part). The plug 5 includes the plurality of plug contacts 41 (the first metal parts) arranged in a row and the plug housing 40 (the first housing) that holds the plurality of plug contacts 41 by insert molding. The plurality of plug contacts 41 respectively have the first bending portion 50 (the bending portion). The first bending portions 50 of the plurality of plug contacts 41 are aligned when viewed from the direction where the plurality of plug contacts 41 are arranged. The receptacle 3 includes the second metal parts (corresponding to the receptacle contact 7 and the auxiliary metal fitting 8) and the receptacle housing 6 (the second housing) that holds the plurality of second metal parts. When the plug 5 is mated with the receptacle 3, the plurality of plug contacts 41 of the plug 5 are brought into contact with the plurality of respective second metal parts of the receptacle 3. When each plug contact 41 is brought into contact with the corresponding second metal part, the second metal part exerts the resistance force against the pull-out of the plug 5 from the receptacle 3 (the resistance force corresponding to the auxiliary metal fitting locking force and the contact locking force). The magnitude of the resistance force exerted by the auxiliary metal fitting 8 (the special metal part) as one of the plurality of second metal parts of the receptacle 3 is configured to be different from the magnitude of the resistance force of the receptacle contacts 7 (the normal metal parts) as the second metal parts other than the auxiliary metal fitting 8. In other words, the magnitude of the auxiliary metal fitting locking force differs from that of the contact locking force. With the above configuration, it is possible to adjust the connector locking force as the resistance force necessary between the plug 5 and the receptacle 3 by the auxiliary metal fitting 8. Moreover, the plurality of plug contacts 41 can be connected to each other and transported at the same time by one carrier K. This enables low cost manufacturing of the plug 5.

Note that the portion of the auxiliary metal fitting 8 where the auxiliary metal fitting locking force is exerted is the spring piece body 34 of the lock spring piece 31 of the auxiliary metal fitting 8. Similarly, the portion of the receptacle contact 7 where the contact locking force is exerted is the outer contact point portion 17 of the receptacle contact 7.

(2) Further, the plurality of plug contacts 41 of the plug 5 have an identical shape. This enables low cost manufacturing of the plug 5.

(3) Furthermore, the spring piece body 34 of the lock spring piece 31 of the auxiliary metal fitting 8 has a different thickness from the thickness of the outer contact point portion 17 of the receptacle contact 7. According to the above configuration, a difference between the magnitude of the auxiliary metal fitting locking force and the magnitude of the contact locking force can be established with a simple configuration.

(4) In addition, the width of the spring piece body 34 of the lock spring piece 31 of the auxiliary metal fitting 8 may be different from the width of the outer contact point portion 17 of the receptacle contact 7. Also, with such a simple configuration as mentioned above, a difference between the magnitude of the auxiliary metal fitting locking force and the magnitude of the contact locking force can be established.

(5) Moreover, the material of the spring piece body 34 of the lock spring piece 31 of the auxiliary metal fitting 8 may be different from the material of the outer contact point portion 17 of the receptacle contact 7. Further with such a simple configuration as mentioned above, a difference between the magnitude of the auxiliary metal fitting locking force and the magnitude of the contact locking force can be established.

(6) Still further, the receptacle 3 is mounted on the receptacle-side substrate 2 (the substrate). The auxiliary metal fitting 8 includes the lock protuberance holding portion 35, the interference portion 36 that is formed to extend from the lock protuberance holding portion 35, the lock protuberance 32 that is formed to the lock protuberance holding portion 35 and hooks on the plug 5 to thereby exert the auxiliary metal fitting locking force as a part of the connector locking force (the resistance force), and the displacement restricting portion 33 that is disposed opposite to the receptacle-side substrate 2 when viewed from the interference portion 36 and also is fixed to the receptacle-side substrate 2. According to the above configuration, it is possible to restrict excessive displacement of the lock protuberance 32 in the substrate away direction.

Figure 18:
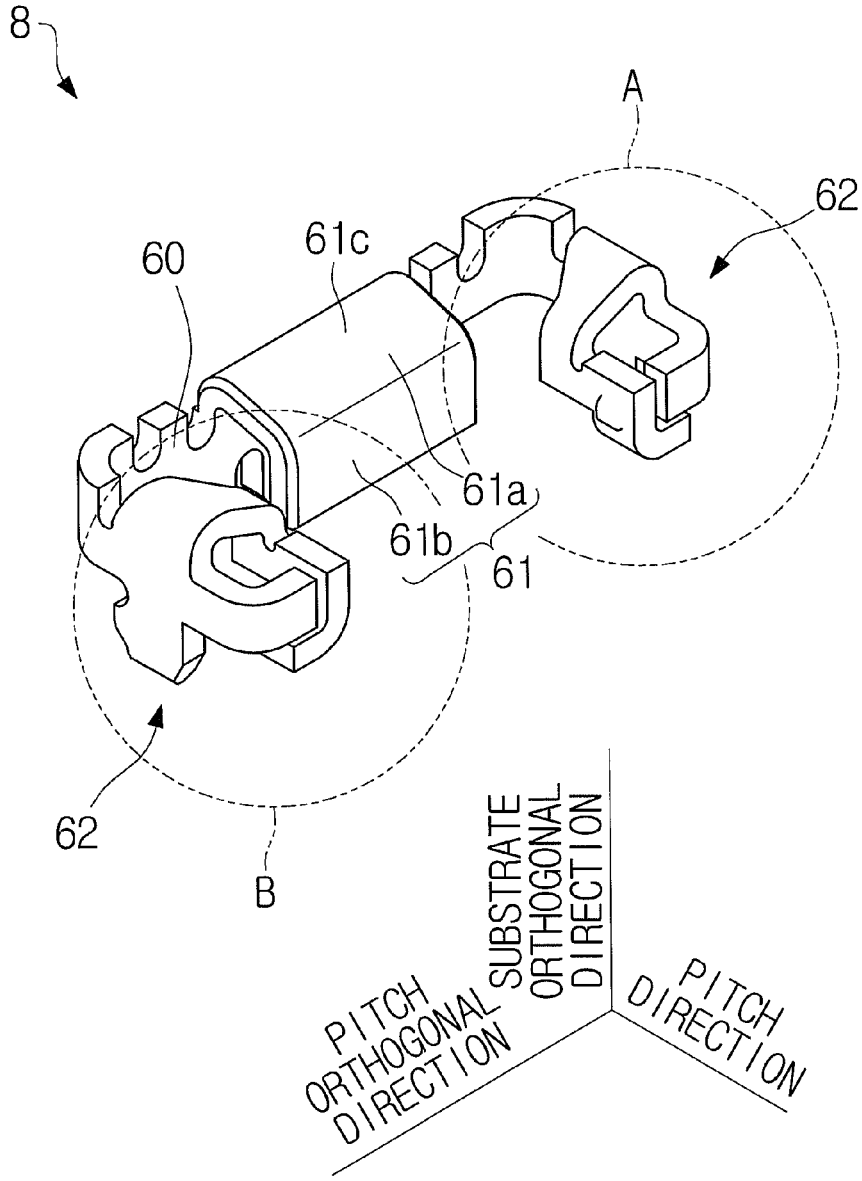
FIG. 18 is a perspective view of an auxiliary metal fitting (the first embodiment)

Next, the auxiliary metal fitting 8 of the first embodiment is explained again with reference to FIGS. 18 to 20. As shown in FIG. 18, the auxiliary metal fitting 8 includes an auxiliary metal fitting body 60, a guide 61, and a pair of locking units 62.

The auxiliary metal fitting body 60 is formed to extend toward the pitch orthogonal direction.

The guide 61 is a portion for aligning the plug 5 with the receptacle 3 in the pitch direction when the plug 5 is mated with the receptacle 3. The guide 61 has a straight inclined portion 61*a* and a straight vertical portion 61*b*. At the center of the auxiliary metal fitting body 60 in the pitch orthogonal direction, the straight inclined portion 61*a* is formed to extend from an end of the auxiliary metal fitting body 60 in the substrate away direction toward the pitch center direction with a slight inclination toward the substrate approaching direction. The straight inclined portion 61*a* has a flat guiding surface 61*c*. The straight vertical portion 61*b* is formed to extend from an end of the straight inclined portion 61*a* in the pitch center direction toward the substrate approaching direction.

The pair of locking units 62 is formed to protrude from both ends of the auxiliary metal fitting body 60 in the pitch orthogonal direction toward the pitch center direction. Since the pair of locking units 62 has a symmetrical shape, only one of the locking units 62 is explained and the explanation of the other locking unit 62 shall not be provided.

Figure 19:
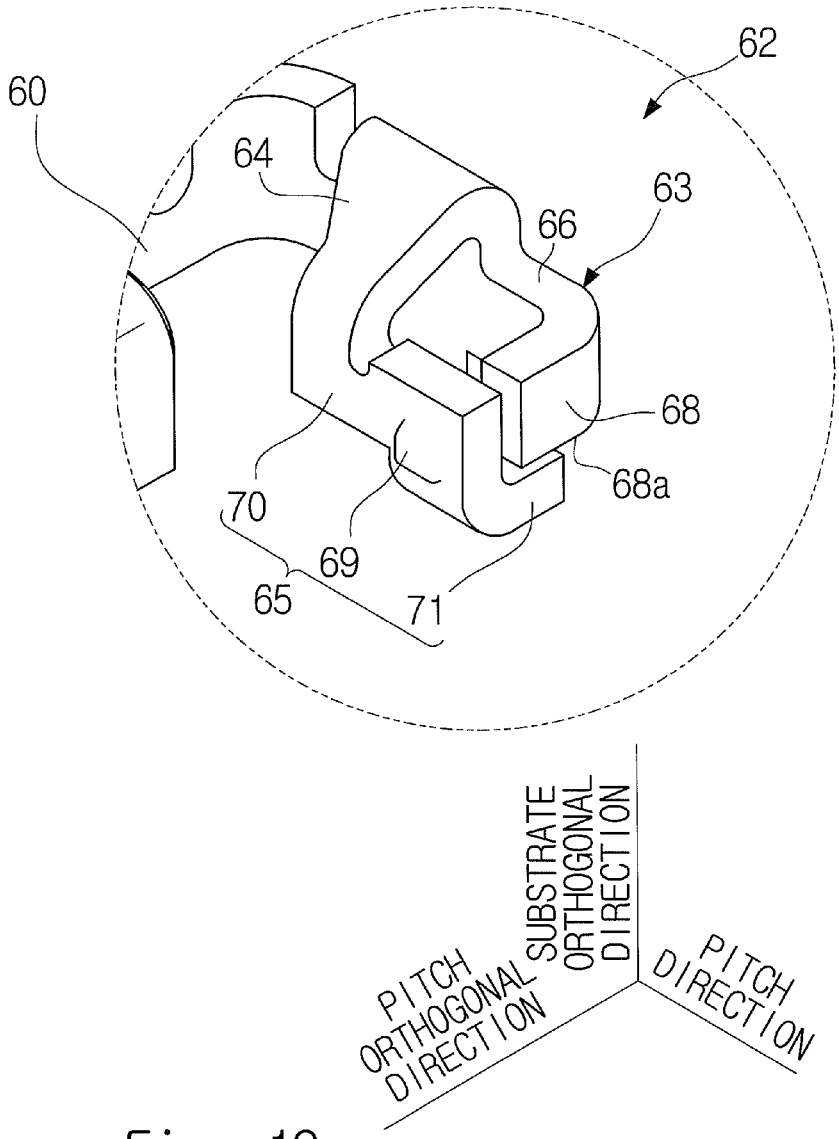
FIG. 19 is an enlarged view of a section A in FIG. 18 (the first embodiment)
Figure 20:
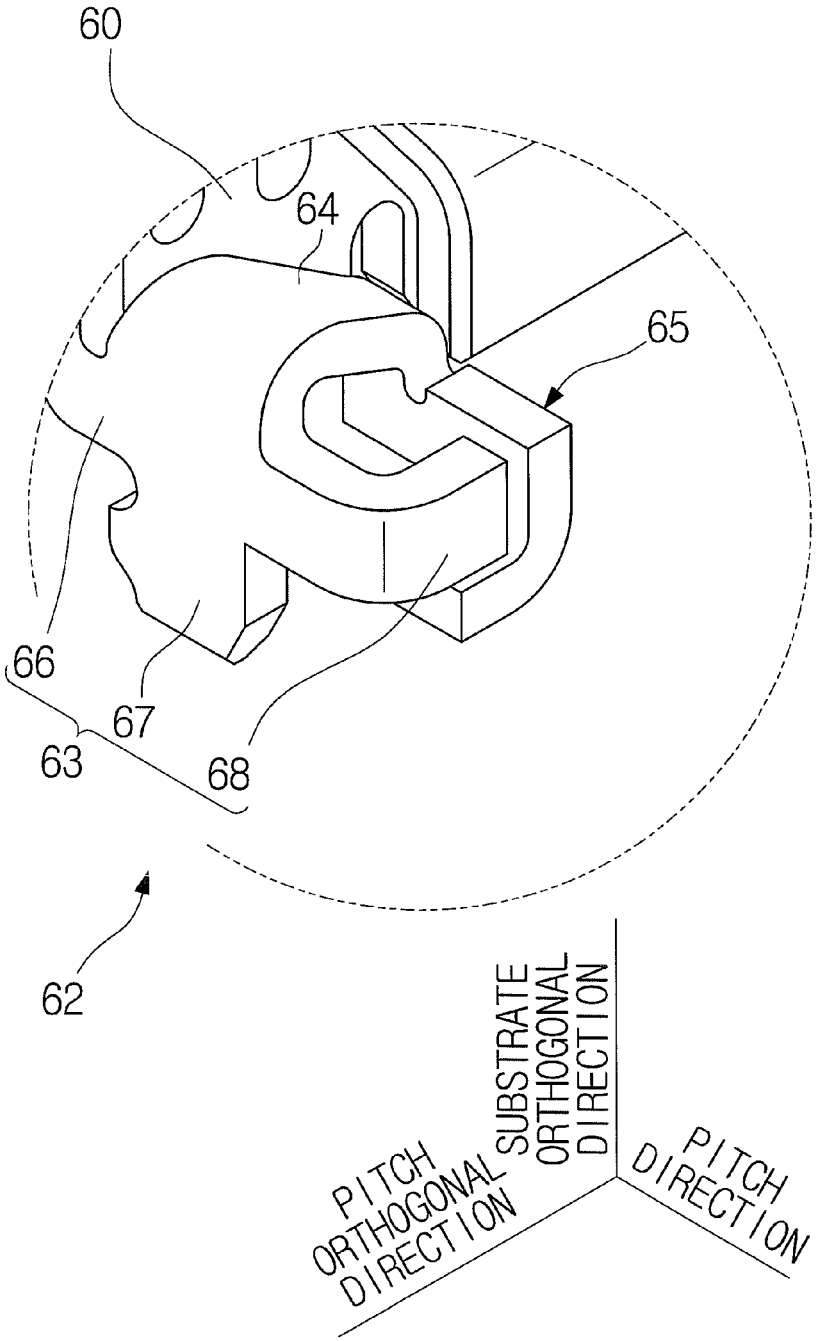
FIG. 20 is an enlarged view of a section B in FIG. 18 (the first embodiment)

As shown in FIGS. 19 and 20, the locking unit 62 has a displacement forbidden portion 63, an easy-to-deform portion 64, and a displacement allowed portion 65.

The displacement forbidden portion 63 is a portion fixed to the receptacle-side substrate 2 to be thereby forbidden from being displaced on the receptacle-side substrate 2. As shown in FIG. 20, the displacement forbidden portion 63 has a displacement forbidden portion body 66, a fixed portion 67, and a displacement restricting portion 68. The displacement forbidden portion body 66 is formed to extend from an end of the auxiliary metal fitting body 60 in the pitch orthogonal anti-center direction toward the pitch center direction. The fixed portion 67 is a portion for fixing the receptacle housing 6 to the connector mounting surface 2*a* of the receptacle-side substrate 2. The fixed portion 67 is formed to extend from a central portion of the displacement forbidden portion body 66 in the pitch direction toward the substrate approaching direction. The fixed portion 67 is press-fit into the receptacle housing 6 and also fixed to the connector mounting surface 2*a* of the receptacle-side substrate 2 by soldering thereto. The displacement restricting portion 68 restricts the displacement allowed portion 65 from being displaced in the pitch orthogonal anti-center direction and the substrate away direction. The displacement restricting portion 68 is formed to extend from an end of the displacement forbidden portion body 66 in the pitch center direction toward the pitch orthogonal center direction. All of the thickness direction of the displacement forbidden portion body 66, the thickness direction of the fixed portion 67, and the thickness direction of the displacement restricting portion 68 are substantially orthogonal to the substrate orthogonal direction. Accordingly, displacement of the displacement restricting portion 68 in the substrate away direction and elastoplastic flexural deformation of the displacement restricting portion 68 in the substrate away direction is strongly forbidden.

The easy-to-deform portion 64 elastically supports the displacement allowed portion 65 to enable the displacement allowed portion 65 to be displaced in the pitch orthogonal direction and the substrate orthogonal direction. As shown in FIG. 20, the easy-to-deform portion 64 is formed in a beam shape extending from an end of the displacement forbidden portion body 66 of the displacement forbidden portion 63 in the substrate away direction toward the pitch orthogonal center direction with a slight inclination toward the substrate approaching direction to enable easy deformation.

The displacement allowed portion 65 is elastically supported by the displacement forbidden portion 63 with the easy-to-deform portion 64 interposed therebetween. As shown in FIG. 19, the displacement allowed portion 65 has a lock protuberance 69 (a contacting portion), a holding portion 70, and an interference portion 71. The lock protuberance 69 is a portion that can be in contact with the plug contact 41 of the plug 5. When the lock protuberance 69 is brought into contact with the plug contact 41 of the plug 5, the auxiliary metal fitting 8 exerts the auxiliary metal fitting locking force as a part of the connector locking force. The holding portion 70 holds the lock protuberance 69. The holding portion 70 is formed to extend from an end of the easy-to-deform portion 64 in the pitch orthogonal center direction toward the pitch center direction. The lock protuberance 69 is formed by protruding a part of the holding portion 70 outwardly in the pitch orthogonal center direction. The holding portion 70 is disposed slightly distant from the displacement restricting portion 68 in the pitch orthogonal center direction when viewed from the displacement restricting portion 68 and faces the displacement restricting portion 68 in the pitch orthogonal direction. This therefore allows a predetermined amount of displacement of the displacement allowed portion 65 in the pitch orthogonal anti-center direction, and also forbids excessive displacement of the displacement allowed portion 65 in the pitch orthogonal anti-center direction exceeding a predetermined amount. The interference portion 71 is a portion that can be in contact with the displacement restricting portion 68 of the displacement forbidden portion 63 in the substrate away direction. The interference portion 71 is formed to extend from an end of the holding portion 70 in the pitch center direction toward the pitch orthogonal anti-center direction. The interference portion 71 is disposed slightly distant from the displacement restricting portion 68 in the substrate approaching direction when viewed from the displacement restricting portion 68 and faces the displacement restricting portion 68 in the substrate orthogonal direction. This therefore allows minute displacement of the displacement allowed portion 65 in the substrate away direction and also forbids excessive displacement of the displacement allowed portion 65 in the substrate away direction. The thickness direction of the holding portion 70 is substantially orthogonal to the substrate orthogonal direction, whereas the thickness direction of the interference portion 71 is substantially parallel to the substrate orthogonal direction. Since the thickness direction of the interference portion 71 is substantially parallel to the substrate orthogonal direction, it is possible to bring the interference portion 71 into firm contact with a lower surface 68*a* of the displacement restricting portion 68.

The auxiliary metal fitting 8 of the first embodiment has been explained again. The above-mentioned first embodiment has the following features.

(7) The receptacle 3 (the second connector part) is mounted on the receptacle-side substrate 2 (substrate). The auxiliary metal fitting 8 (the special metal part) has the displacement forbidden portion 63 that is fixed to the receptacle-side substrate 2 to be thereby forbidden from being displaced on the receptacle-side substrate 2, the easy-to-deform portion 64 that is formed in a beam shape extending from the displacement forbidden portion 63 to enable easy deformation, and the displacement allowed portion 65 that is supported by the displacement forbidden portion 63 with the easy-to-deform portion 64 interposed therebetween. The displacement allowed portion 65 has the lock protuberance 69 (the contacting portion) that can be in contact with the plug contact 41 (the first metal part) of the plug 5, the holding portion 70 that holds the lock protuberance 69, and the interference portion 71 that can be in contact with the displacement forbidden portion 63 in the substrate away direction (a pull-out direction that is a direction to pull out the plug 5 from the receptacle 3). It is configured such that when the lock protuberance 69 of the displacement allowed portion 65 is brought into contact with the plug contact 41 of the plug 5, the auxiliary metal fitting 8 exerts the auxiliary metal fitting locking force as a part of the connector locking force (the resistance force). When the interference portion 71 is brought into contact with the displacement forbidden portion 63 in the substrate away direction, displacement of the displacement allowed portion 65 in the substrate away direction is restricted. According to the above configuration, displacement of the displacement allowed portion 65 in the substrate away direction is restricted when the plug 5 is pulled out from the receptacle 3, thereby suppressing plastic deformation of the easy-to-deform portion 64 that is caused by the displacement of the displacement allowed portion 65 in the substrate away direction. Hence, the easy-to-deform portion 64 is not damaged by repeated pull-out, thereby exerting stable auxiliary metal locking force.

(11) The thickness direction of the interference portion 71 is substantially parallel to the substrate away direction. According to the above configuration, it is possible to bring the interference portion 71 into firmer contact with the displacement restricting portion 68 than in the case where the thickness direction of the interference portion 71 is substantially orthogonal to the substrate away direction.

Second Embodiment

Figure 21:
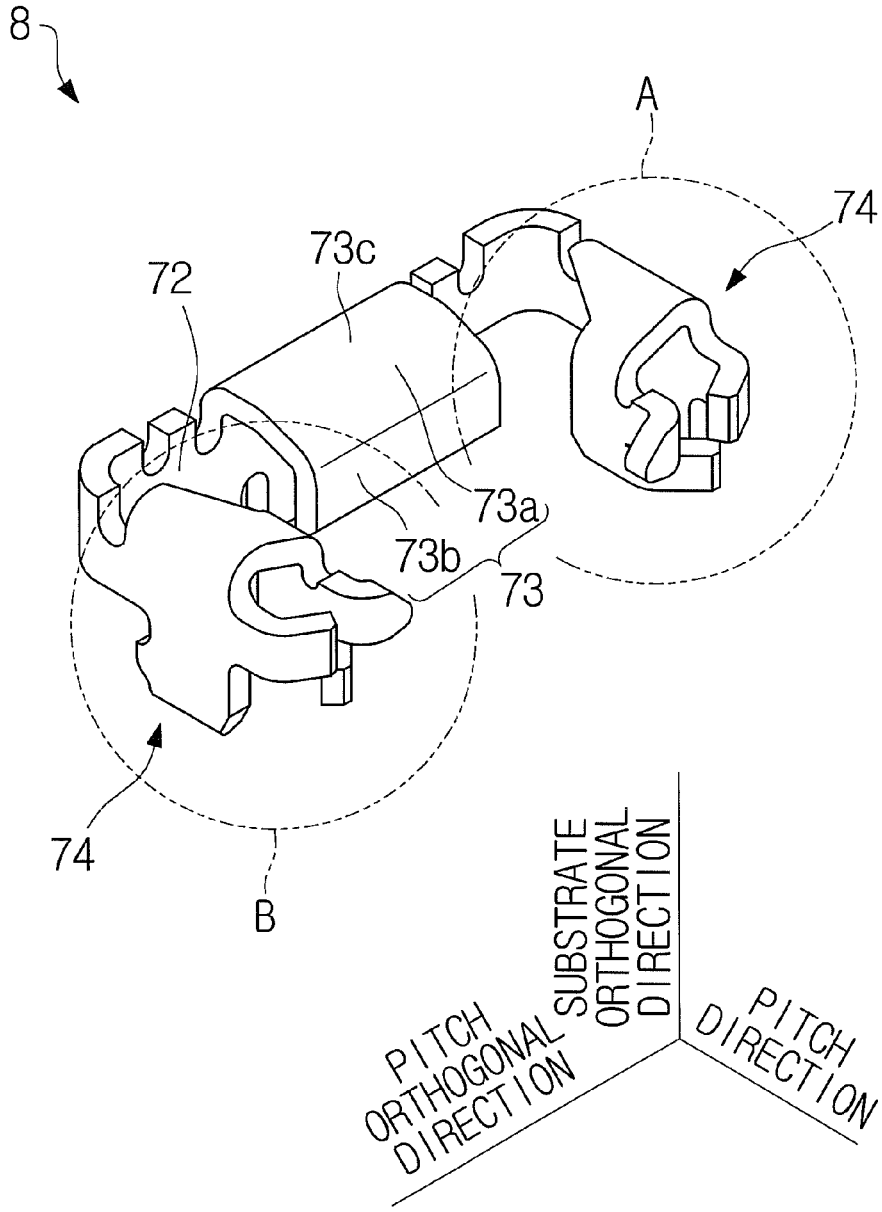
FIG. 21 is a perspective view of an auxiliary metal fitting (a second embodiment)
Figure 22:
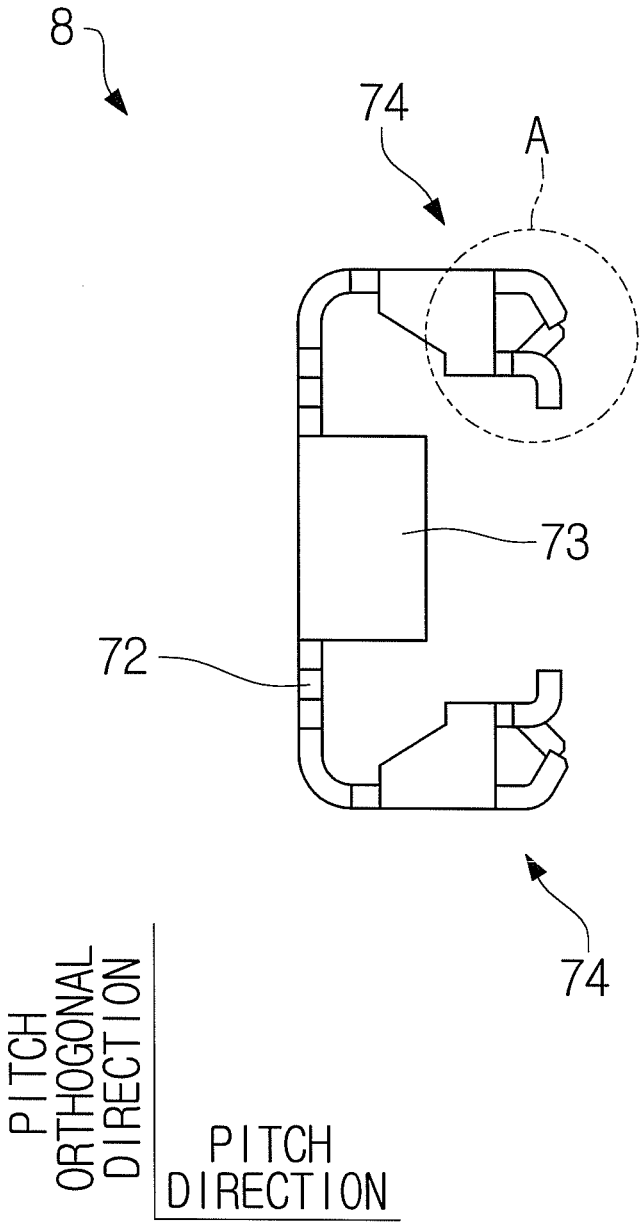
FIG. 22 is a perspective view of the auxiliary metal fitting (the second embodiment)

Next, an auxiliary metal fitting 8 according to a second embodiment is explained with reference to FIGS. 21 to 25. As shown in FIGS. 21 and 22, the auxiliary metal fitting 8 has an auxiliary metal fitting body 72, a guide 73, and a pair of locking units 74.

The auxiliary metal fitting body 72 is formed to extend toward the pitch orthogonal direction.

The guide 73 is a portion for aligning the plug 5 with the receptacle 3 in the pitch direction when the plug 5 is mated with the receptacle 3. As shown in FIG. 21, the guide 73 has a straight inclined portion 73*a* and a straight vertical portion 73*b*. At the center of the auxiliary metal fitting body 72 in the pitch orthogonal direction, the straight inclined portion 73*a* is formed to extend from an end of the auxiliary metal fitting body 72 in the substrate away direction toward the pitch center direction with a slight inclination toward the substrate approaching direction. The straight inclined portion 73*a* has a flat guiding surface 73*c*. The straight vertical portion 73*b* is formed to extend from an end of the straight inclined portion 73*a* in the pitch center direction toward the substrate approaching direction.

The pair of locking units 74 is formed to protrude from both ends of the auxiliary metal fitting body 72 in the pitch orthogonal direction toward the pitch center direction. Since the pair of locking units 74 has a symmetrical shape, only one of the locking units 74 is explained and the explanation of the other locking unit 74 shall not be provided.

Figure 23:
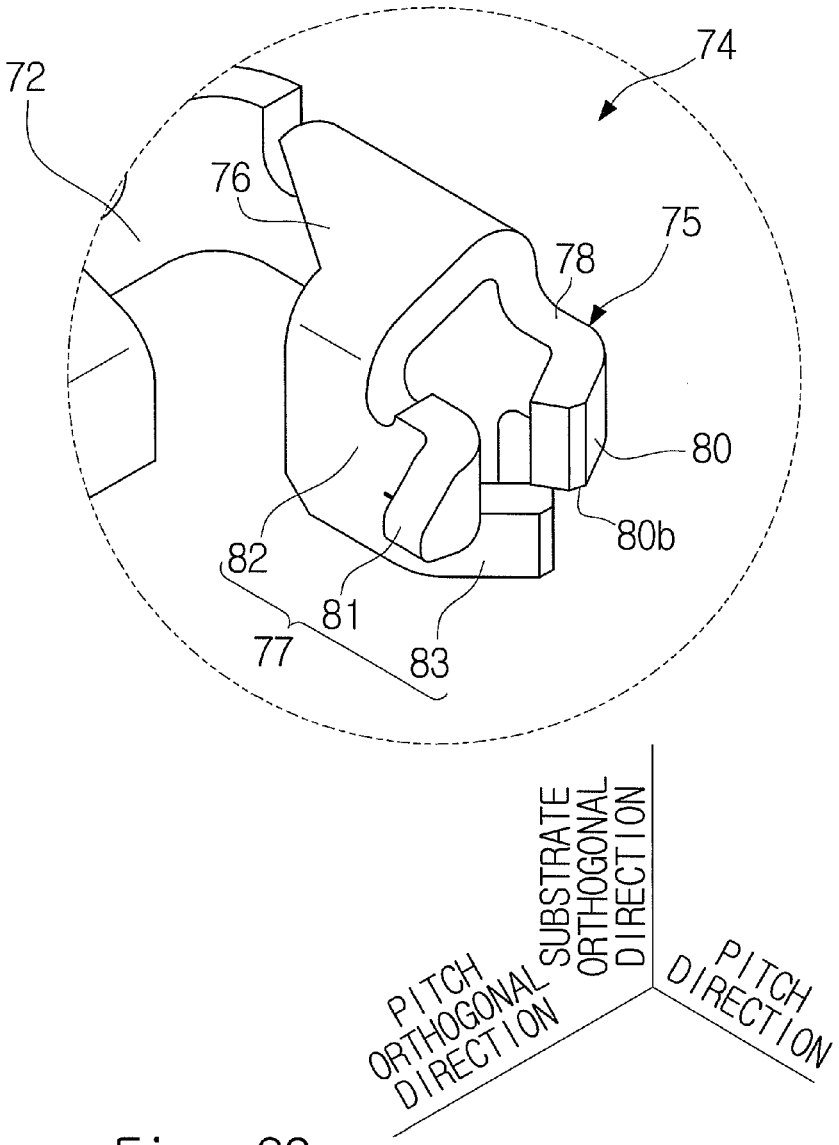
FIG. 23 is an enlarged view of a section A in FIG. 21 (the second embodiment)
Figure 24:
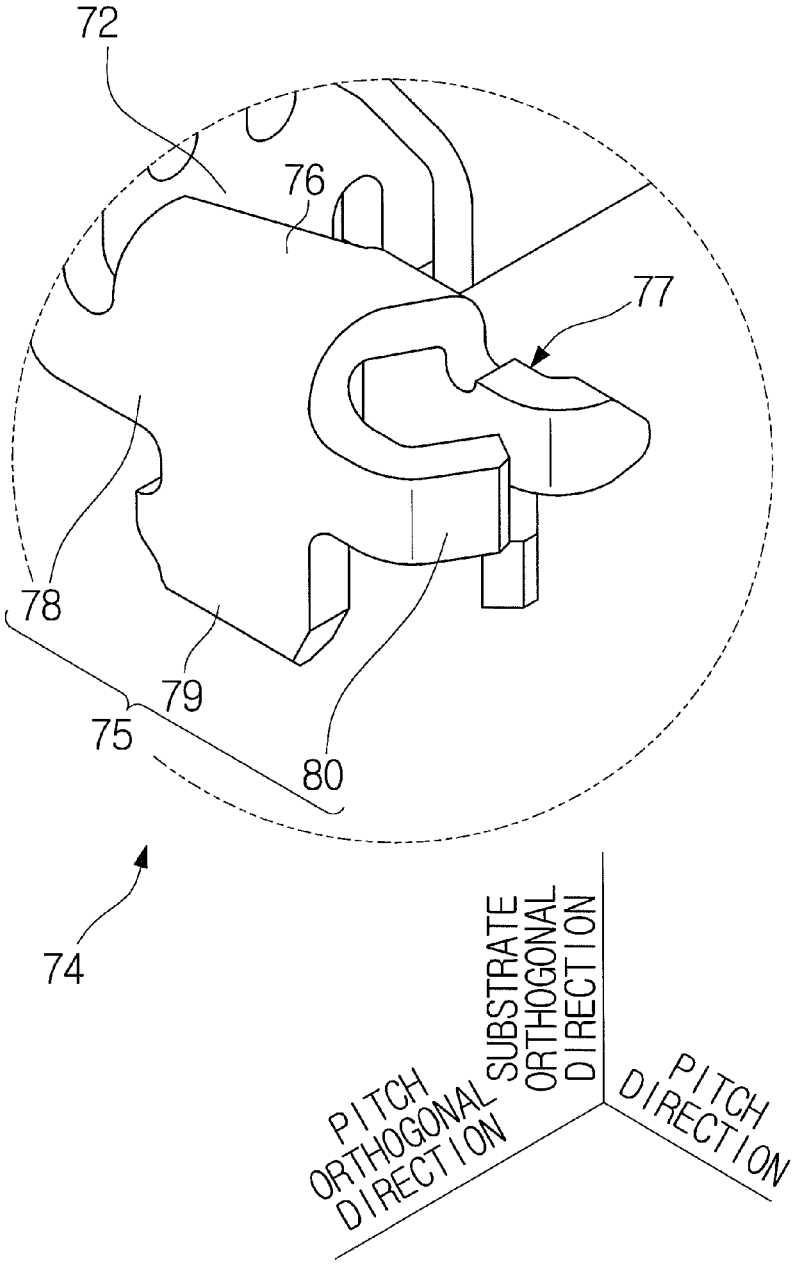
FIG. 24 is an enlarged view of a section B in FIG. 21 (the second embodiment)
Figure 25:
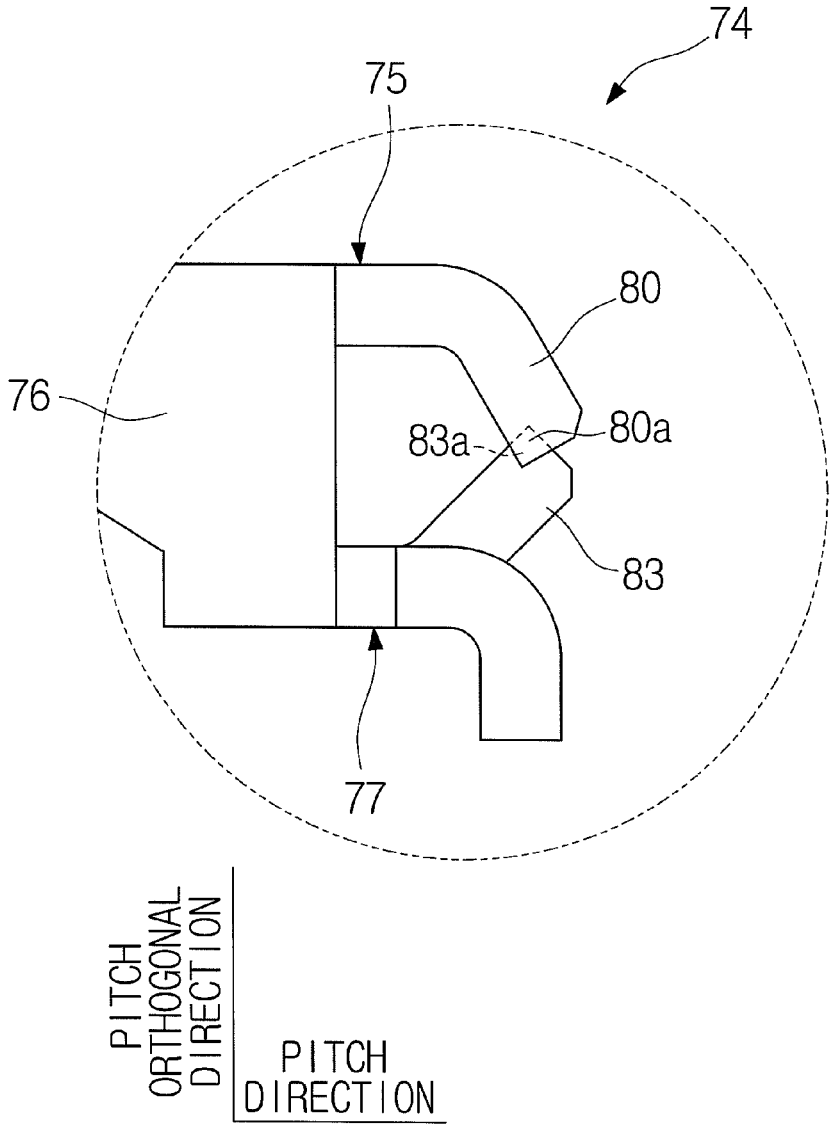
FIG. 25 is an enlarged diagram of a section A in FIG. 22 (the second embodiment).

As shown in FIGS. 23 and 24, the lock unit 74 has a displacement forbidden portion 75, an easy-to-deform portion 76, and a displacement allowed portion 77.

The displacement forbidden portion 75 is a portion fixed to the receptacle-side substrate 2 to be thereby forbidden from being displaced on the receptacle-side substrate 2. As shown in FIG. 24, the displacement forbidden portion 75 has a displacement forbidden portion body 78, a fixed portion 79, and a displacement restricting portion 80. The displacement forbidden portion body 78 is formed to extend from an end of the auxiliary metal fitting body 72 in the pitch orthogonal anti-center direction toward the pitch center direction. The fixed portion 79 is a portion for fixing the receptacle housing 6 to the connector mounting surface 2*a* of the receptacle-side substrate 2. The fixed portion 79 is formed to extend from a central portion of the displacement forbidden portion body 78 in the pitch direction toward the substrate approaching direction. The fixed portion 79 is press-fit into the receptacle housing 6 and also fixed to the connector mounting surface 2*a* of the receptacle-side substrate 2 by soldering thereto. The displacement restricting portion 80 restricts the displacement allowed portion 77 from being displaced in the substrate away direction. The displacement restricting portion 80 extends obliquely from an end of the displacement forbidden portion body 78 in the pitch center direction toward the pitch orthogonal center direction and the pitch center direction. All of the thickness direction of the displacement forbidden portion body 78, the thickness direction of the fixed portion 79, and the thickness direction of the displacement restricting portion 80 are substantially orthogonal to the substrate orthogonal direction. Accordingly, displacement of the displacement restricting portion 80 in the substrate away direction and elastoplastic flexural deformation of the displacement restricting portion 80 in the substrate away direction is strongly forbidden.

The easy-to-deform portion 76 elastically supports the displacement allowed portion 77 to enable the displacement allowed portion 77 to be displaced in the pitch orthogonal direction and the substrate orthogonal direction. As shown in FIG. 23, the easy-to-deform portion 76 is formed in a beam shape extending from an end of the displacement forbidden portion body 78 of the displacement forbidden portion 75 in the substrate away direction toward the pitch orthogonal center direction with a slight inclination toward the substrate approaching direction to enable easy deformation.

The displacement allowed portion 77 is elastically supported by the displacement forbidden portion 75 with the easy-to-deform portion 76 interposed therebetween. As shown in FIG. 23, the displacement allowed portion 77 has a locking pawl 81 (a contacting portion), a holding portion 82, and an interference portion 83. The locking pawl 81 is a portion that can be in contact with the plug contact 41 of the plug 5. When the locking pawl 81 is brought into contact with the plug contact 41 of the plug 5, the auxiliary metal fitting 8 exerts the auxiliary metal fitting locking force as a part of the connector locking force. The holding portion 82 holds the locking pawl 81. The holding portion 82 is formed to extend from an end of the easy-to-deform portion 76 in the pitch orthogonal center direction toward the pitch center direction. The locking pawl 81 is formed by bending a tip of the holding portion 82 in the pitch center direction at 90 degrees in the pitch orthogonal center direction. The interference portion 83 is a portion that can be in contact with the displacement restricting portion 80 of the displacement forbidden portion 75 in the substrate away direction. The interference portion 83 is formed to extend obliquely from the holding portion 82 toward the pitch orthogonal anti-center direction and the pitch center direction. The interference portion 83 is disposed slightly distant from the displacement restricting portion 80 in the substrate approaching direction when viewed from the displacement restricting portion 80 and faces the displacement restricting portion 80 in the substrate orthogonal direction. This therefore allows minute displacement of the displacement allowed portion 77 in the substrate away direction and also forbids excessive displacement of the displacement allowed portion 77 in the substrate away direction. Further, as shown in the planar view of FIG. 25, a tip 83*a* of the interference portion 83 faces a tip 80*a* of the displacement restricting portion 80 in the substrate orthogonal direction. Furthermore, as shown in the planar view of FIG. 25, the longitudinal direction of the interference portion 83 and the longitudinal direction of the displacement restricting portion 80 are different. In other words, as shown in the planar view of FIG. 25, the thickness direction of the interference portion 83 and the thickness direction of the displacement restricting portion 80 are different. To put it briefly, as shown in the planar view of FIG. 25, the interference portion 83 and the displacement restricting portion 80 intersect with each other. This therefore makes it possible to bring the interference portion 83 into firm contact with a lower surface 80*b* of the displacement restricting portion 80 (see also FIG. 23). Moreover, all of the thickness direction of the locking pawl 81, the thickness direction of the holding portion 82, and the thickness direction of the interference portion 83, are substantially orthogonal to the substrate orthogonal direction. Therefore, displacement of the locking pawl 81, the holding portion 82, and the interference portion 83 in the substrate away direction and elastoplastic flexural deformation of the locking pawl 81, the holding portion 82, and the interference portion 83 in the substrate away direction is strongly forbidden when external force is imposed on the locking pawl 81 in the substrate away direction while the plug 5 is pulled out from the receptacle 3, and the interference portion 83 is brought into contact with the displacement restricting portion 80.

The second embodiment of the present invention has been explained above. The second embodiment has the following features.

(7) The receptacle 3 is mounted on the receptacle-side substrate 2. The auxiliary metal fitting 8 has the displacement forbidden portion 75 that is fixed to the receptacle-side substrate 2 to be thereby forbidden from being displaced on the receptacle-side substrate 2, the easy-to-deform portion 76 that is formed in a beam shape extending from the displacement forbidden portion 75 to enable easy deformation, and the displacement allowed portion 77 that is supported by the displacement forbidden portion 75 with the easy-to-deform portion 76 interposed therebetween. The displacement allowed portion 77 has the locking pawl 81 (the contacting portion) that can be in contact with the plug contact 41 of the plug 5, the holding portion 82 that holds the locking pawl 81, and the interference portion 83 that can be in contact with the displacement forbidden portion 75 in the substrate away direction. When the locking pawl 81 of the displacement allowed portion 77 is brought into contact with the plug contact 41 of the plug 5, the auxiliary metal fitting 8 exerts the auxiliary metal fitting locking force (the resistance force) as a part of the connector locking force. When the interference portion 83 is brought into contact with the displacement forbidden portion 75 in the substrate away direction, displacement of the displacement allowed portion 77 in the substrate away direction is restricted. According to the above configuration, displacement of the displacement allowed portion 77 in the substrate away direction is restricted when the plug 5 is pulled out from the receptacle 3, thereby suppressing plastic deformation of the easy-to-deform portion 76 that is caused by the displacement of the displacement allowed portion 77 in the substrate away direction. Hence, the easy-to-deform portion 76 is not damaged by repeated pull-out, thereby exerting stable auxiliary metal locking force.

(8) The thickness direction of the interference portion 83 is a direction substantially orthogonal to the substrate away direction. According to the above configuration, it is possible to improve rigidity of the interference portion 83 in the substrate away direction, thereby ensuring restriction on displacement of the displacement allowed portion 77 in the substrate away direction when the plug 5 is pulled out from the receptacle 3.

(9) The displacement forbidden portion 75 has the displacement restricting portion 80 in contact with the interference portion 83 in the substrate away direction. The thickness direction of the displacement restricting portion 80 is substantially orthogonal to the substrate away direction. According to the above configuration, it is possible to improve rigidity of the displacement restricting portion 80 in the substrate away direction, thereby ensuring restriction on displacement of the displacement allowed portion 77 in the substrate away direction when the plug 5 is pulled out from the receptacle 3.

(10) The thickness direction of the interference portion 83 and the thickness direction of the displacement restricting portion 80 are different in a view of the substrate orthogonal direction (the substrate away direction). According to the above configuration, it is possible to bring the interference portion 83 into firmer contact with the displacement restricting portion 80 than in the case where the thickness direction of the interference portion 83 and the thickness direction of the displacement restricting portion 80 are the same in a view of the substrate orthogonal direction (the substrate away direction).

Preferred first and second embodiments of the present invention have been explained so far. The first and second embodiments can be modified as follows, for example.

As shown in FIG. 19, in the first embodiment, the interference portion 71 is brought into contact with the displacement restricting portion 68 in the substrate away direction so as to restrict displacement of the displacement allowed portion 65 in the substrate away direction. Alternatively, the interference portion 71 may be brought into contact with the receptacle housing 6 in the substrate away direction so as to restrict displacement of the displacement allowed portion 65 in the substrate away direction. Similarly, as shown in FIG. 23, in the second embodiment, the interference portion 83 is brought into contact with the displacement restricting portion 80 in the substrate away direction so as to restrict displacement of the displacement allowed portion 77 in the substrate away direction. Alternatively, the displacement allowed portion 77 may be brought into contact with the receptacle housing 6 in the substrate away direction so as to restrict displacement of the displacement allowed portion 77 in the substrate away direction.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector comprising:

a first connector part that includes a plurality of first metal parts arranged in a row and a first housing holding the plurality of first metal parts by insert molding, the plurality of first metal parts each having at least one bending portion that bends, the bending portions of the plurality of first metal parts being aligned in a direction where the plurality of first metal parts are arranged, and the plurality of first metal parts each having an identical shape; and a second connector part that includes a plurality of second metal parts and a second housing holding the plurality of second metal parts, wherein when the first connector part and the second connector part are mated, the plurality of first metal parts of the first connector part are brought into contact with the plurality of respective second metal parts of the second connector part, when the first metal parts are brought into contact with the respective second metal parts, each of the second metal parts exerts a resistance force against pull-out of the first connector part from the second connector part, and a magnitude of the resistance force of a special metal part which is one of the plurality of second metal parts of the second connector part is configured to be different from a magnitude of the resistance force of a normal metal part which is one of the plurality of second metal parts other than the special metal part.

2. The connector according to claim 1, wherein a thickness of a portion of the special metal part exerting the resistance force is different from a thickness of a portion of the normal metal part exerting the resistance force.

3. The connector according to claim 1, wherein a width of a portion of the special metal part exerting the resistance force is different from a width of a portion of the normal metal part exerting the resistance force.

4. The connector according to claim 1, wherein a material of a portion of the special metal part exerting the resistance force is different from a material of a portion of the normal metal part exerting the resistance force.

5. The connector according to claim 1, wherein the second connector part is mounted on a substrate, and the special metal part includes:

a lock protuberance holding portion;

an interference portion that is formed to extend from the lock protuberance holding portion;

a lock protuberance that is formed to the lock protuberance holding portion and hooks on the first connector part to exert the resistance force; and a displacement restricting portion that is disposed opposite to the substrate in a view from the interference portion and is also fixed to the substrate.

6. The connector according to claim 1, wherein the second connector part is mounted on a substrate, the special metal part includes: a displacement forbidden portion that is fixed to the substrate to be forbidden from being displaced on the substrate; an easy-to-deform portion that is formed in a beam shape extending from the displacement forbidden portion to enable easy deformation, and a displacement allowed portion that is supported by the displacement forbidden portion with the easy-to-deform portion interposed therebetween, the displacement allowed portion includes: a contacting portion that can be in contact with the first metal part, a holding portion that holds the contacting portion, and an interference portion that can be in contact with the displacement forbidden portion in a pull-out direction that is a direction to pull out the first connector part from the second connector part, when the contacting portion of the displacement allowed portion is brought into contact with the first metal part, the special metal part exerts the resistance force, and when the interference portion is brought into contact with the displacement forbidden portion in the pull-out direction, displacement of the displacement allowed portion in the pull-out direction is restricted.

7. The connector according to claim 6, wherein a thickness direction of the interference portion is a direction substantially orthogonal to the pull-out direction.

8. The connector according to claim 7, wherein the displacement forbidden portion includes a displacement restricting portion to be in contact with the interference portion in the pull-out direction, and a thickness direction of the displacement restricting portion is a direction substantially orthogonal to the pull-out direction.

9. The connector according to claim 8, wherein the thickness direction of the interference portion and the thickness direction of the displacement restricting portion are different in a view of the pull-out direction.

10. The connector according to claim 6, wherein the thickness direction of the interference portion is substantially parallel to the pull-out direction.

11. A connector comprising:

a first connector part that includes a plurality of first metal parts arranged in a row and a first housing holding the plurality of first metal parts by insert molding, the plurality of first metal parts each having at least one bending portion that bends, and the bending portions of the plurality of first metal parts being aligned in a direction where the plurality of first metal parts are arranged; and a second connector part that includes a plurality of second metal parts and a second housing holding the plurality of second metal parts, wherein when the first connector part and the second connector part are mated, the plurality of first metal parts of the first connector part are brought into contact with the plurality of respective second metal parts of the second connector part, when the first metal parts are brought into contact with the respective second metal parts, each of the second metal parts exerts a resistance force against pull-out of the first connector part from the second connector part, a magnitude of the resistance force of a special metal part which is one of the plurality of second metal parts of the second connector part is configured to be different from a magnitude of the resistance force of a normal metal part which is one of the plurality of the second metal parts other than the special metal part, the second connector part is mounted on a substrate, and the special metal part includes:

a lock protuberance holding portion;

an interference portion that is formed to extend from the lock protuberance portion;

a lock protuberance that is formed to the lock protuberance holding portion and hooks on the first connector part to exert the resistance force; and a displacement restricting portion that is disposed opposite to the substrate in a view from the interference portion and is also fixed to the substrate.

12. A connector comprising:

a first connector part that includes a plurality of first metal parts arranged in a row and a first housing holding the plurality of first metal parts by insert molding, the plurality of first metal parts each having at least one bending portion that bends, and the bending portions of the plurality of first metal parts being aligned in a direction where the plurality of first metal parts are arranged; and a second connector part that includes a plurality of second metal parts and a second housing holding the plurality of second metal parts, wherein when the first connector part and the second connector part are mated, the plurality of first metal parts of the first connector part are brought into contact with the plurality of respective second metal parts of the second connector part, when the first metal parts are brought into contact with the respective second metal parts, each of the second metal parts exerts a resistance force against pull-out of the first connector part from the second connector part, a magnitude of the resistance force of a special metal part which is one of the plurality of second metal parts of the second connector part is configured to be different from a magnitude of the resistance force of a normal metal part which is one of the plurality of the second metal parts other than the special metal part, the second connector part is mounted on a substrate, the special metal part includes: a displacement forbidden portion that is fixed to the substrate to be forbidden from being displaced on the substrate; an easy-to-deform portion that is formed in a beam shape extending from the displacement forbidden portion to enable easy deformation, and a displacement allowed portion that is supported by the displacement forbidden portion with the easy-to-deform portion interposed therebetween, the displacement allowed portion includes: a contacting portion that can be in contact with the first metal part, a holding portion that holds the contacting portion, and an interference portion that can be in contact with the displacement forbidden portion in a pull-out direction that is a direction to pull out the first connector part from the second connector part, when the contacting portion of the displacement allowed portion is brought into contact with the first metal part, the special metal part exerts the resistance force, and when the interference portion is brought into contact with the displacement forbidden portion in the pull-out direction, displacement of the displacement allowed portion in the pull-out direction is restricted.

13. The connector according to claim 12, wherein a thickness direction of the interference portion is a direction substantially orthogonal to the pull-out direction.

14. The connector according to claim 13, wherein the displacement forbidden portion includes a displacement restricting portion to be in contact with the interference portion in the pull-out direction, and a thickness direction of the displacement restricting portion is a direction substantially orthogonal to the pull-out direction.

15. The connector according to claim 14, wherein the thickness direction of the interference portion and the thickness direction of the displacement restricting portion are different in a view of the pull-out direction.

16. The connector according to claim 12, wherein the thickness direction of the interference portion is substantially parallel to the pull-out direction.

* * * * *